US008886061B2

(12) United States Patent
Nozawa et al.

(10) Patent No.: US 8,886,061 B2
(45) Date of Patent: Nov. 11, 2014

(54) DEVELOPER DETECTION DEVICE CAPABLE OF DETECTING AMOUNT DEVELOPER IN DEVELOPER ACCOMMODATING CONTAINER

(75) Inventors: Ken Nozawa, Tokyo (JP); Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 314 days.

(21) Appl. No.: 13/224,314

(22) Filed: Sep. 1, 2011

(65) Prior Publication Data

US 2012/0057886 A1 Mar. 8, 2012

(30) Foreign Application Priority Data

Sep. 2, 2010 (JP) ..... 2010-196857

(51) Int. Cl.
*G03G 15/08* (2006.01)

(52) U.S. Cl.
CPC .... *G03G 15/0831* (2013.01); *G03G 2215/0894* (2013.01)
USPC ..... 399/27

(58) Field of Classification Search
USPC ..... 399/27, 61, 64
See application file for complete search history.

(56) References Cited

U.S. PATENT DOCUMENTS

2003/0228160 A1 12/2003 Inoue et al.
2005/0078978 A1* 4/2005 Suzuki et al. ..... 399/111
2006/0033057 A1* 2/2006 Tang et al. ..... 250/559.27
2007/0071464 A1 3/2007 Yamaguchi
2007/0140743 A1 6/2007 Kamimura
2008/0226331 A1* 9/2008 Allen et al. ..... 399/90

FOREIGN PATENT DOCUMENTS

EP 2 317 396 A2 5/2011
JP 2002-169368 6/2002
JP 2007-093663 A 4/2007
JP 2007-212656 8/2007

OTHER PUBLICATIONS

JP 2002-169368 English translation, Kimura et al., Jun. 2002.*

* cited by examiner

*Primary Examiner* — David Gray
*Assistant Examiner* — Thomas Giampaolo, II
(74) *Attorney, Agent, or Firm* — Rabin & Berdo, P.C.

(57) ABSTRACT

A developer detection device includes: a rotating member including a first part and a second part being joined to the first part, the first part having a light-blocking section and a light-passing section, the second part temporarily stopping rotating at a rotation position corresponding to a developer upper surface position of developer stored in an accommodating container; a rotation driving member pushing the rotating member in a predetermined rotation direction; and a detecting unit including a light-emitting unit and a light-receiving unit; wherein the rotating member is formed so that when the second part is at a lower position in the accommodating container, the light-passing section is positioned on an optical path from the light-emitting unit to the light-receiving unit.

11 Claims, 31 Drawing Sheets

L1
L3
460
460h
63d
W1
β
β =0°
BLOCK
β =20°
BLOCK
β =30°
UNSTABLE
β =40°
PASS
β =50°
PASS
β =60°
PASS
CONVENTIONAL ART

CONVENTIONAL ART

CONVENTIONAL ART

DEVELOPER DETECTION DEVICE CAPABLE OF DETECTING AMOUNT DEVELOPER IN DEVELOPER ACCOMMODATING CONTAINER

BACKGROUND OF THE INVENTION

1. Field of the Invention

The present invention relates to a developer detection device capable of detecting a remaining amount of developer stored in an accommodating container, and a developer accommodating device, a developing unit and an image forming apparatus each including the developer detection device.

2. Description of the Related Art

In general, an electrophotographic image forming apparatus such as a printer, a photocopier, a facsimile and a multifunction peripheral (MFP), includes a developer detection device capable of detecting a remaining amount of developer (toner) stored in an accommodating container of a developing unit. For example, a developer detection device described in Japanese Patent Kokai Publication No. 2007-93663 (Patent Document 1) includes a light blocking plate for blocking light emitted from a light-emitting unit in accordance with the amount of toner in an accommodating container and detects that the amount of toner becomes less than a predetermined reference amount, i.e., the remaining amount of toner is small, on the basis of a light blocked period during which the light from the light-emitting unit is being blocked by the light blocking plate. See Patent Document 1 (e.g., Abstract, FIG. 2, FIGS. 6A and 6B, and FIGS. 7A and 7B).

However, since a stop position of the light blocking plate corresponding to the remaining amount of toner exhibits fluctuations, the stop position of the light blocking plate sometimes does not correctly correspond to the remaining amount of toner. In such a case, even if the remaining amount of toner stored in the accommodating container is small, the light blocking plate cannot appropriately block the light emitted from the light-emitting unit and part of the light emitted from the light-emitting unit enters a light-receiving unit, and therefore the remaining amount of toner cannot be correctly detected. Moreover, in the conventional device, since the light blocking plate is formed to be compact, part of the light emitted from the light-emitting unit tends to enter the light-receiving unit by reflection, scattering or diffraction at another member. Therefore, even if an actual remaining amount of toner becomes small, the light sometimes enters the light-receiving unit. Consequently, the conventional device sometimes can detect that the remaining amount of toner is small, but cannot detect it at other times, when the remaining amount of toner is small. As described above, there is a problem that the remaining amount of toner cannot be detected appropriately.

SUMMARY OF THE INVENTION

An object of the present invention is to provide a developer detection device capable of correctly detecting a remaining amount of developer stored in an accommodating container, and a developer accommodating device, a developing unit and an image forming apparatus each including the developer detection device.

According to an aspect of the present invention, a developer detection device includes: a rotating member including a first part and a second part being joined to the first part, the first part having a light-blocking section and a light-passing section, the second part temporarily stopping rotating at a rotation position corresponding to a developer upper surface position of developer stored in an accommodating container; a rotation driving member pushing the rotating member in a predetermined rotation direction; and a detecting unit including a light-emitting unit and a light-receiving unit; wherein the rotating member is formed so that when the second part is at a lower position in the accommodating container, the light-passing section is positioned on an optical path from the light-emitting unit to the light-receiving unit.

According to another aspect of the present invention, a developer accommodating device includes the developer detection device.

According to still another aspect of the present invention, a developer accommodating device being detachably/attachably fixed to an image forming apparatus including a light-emitting unit and a light-receiving unit for receiving light emitted from the light-emitting unit, the developer accommodating device includes: an accommodating container storing a developer; a stirring member disposed in the accommodating container, the stirring member temporarily stopping rotating at a rotation position corresponding to a developer upper surface position of developer stored in an accommodating container; and a detection plate including a light-blocking section and a light-passing section, the detection plate being joined to the stirring member; wherein when the stirring member is at a lower position in the accommodating container with respect to the light-emitting unit and the light-receiving unit, the light-passing section is positioned on an optical path from the light-emitting unit to the light-receiving unit.

According to yet another aspect of the present invention, a developing unit includes: the above-described developer accommodating device; and a developer carrier supplying the developer stored in the accommodating container to an image carrier.

According to further aspect of the present invention, an image forming apparatus includes the above-described developer detection device.

DETAILED DESCRIPTION OF THE INVENTION

Further scope of applicability of the present invention will become apparent from the detailed description given hereinafter.

A developer detection device to which the present invention is applied can be used in a machine or apparatus using developer (toner), such as an electrophotographic image forming apparatus. An example where the developer detection device is incorporated in a developing unit of an image forming apparatus will be described below. Furthermore, the developer detection device to which the present invention is applied can be incorporated in other kinds of developer accommodating device, such as a waste toner accommodating container, a toner cartridge or the like, which is detachably/attachably fixed to an image forming apparatus, for example.

First Embodiment

<Image Forming Apparatus>

Figure 1:
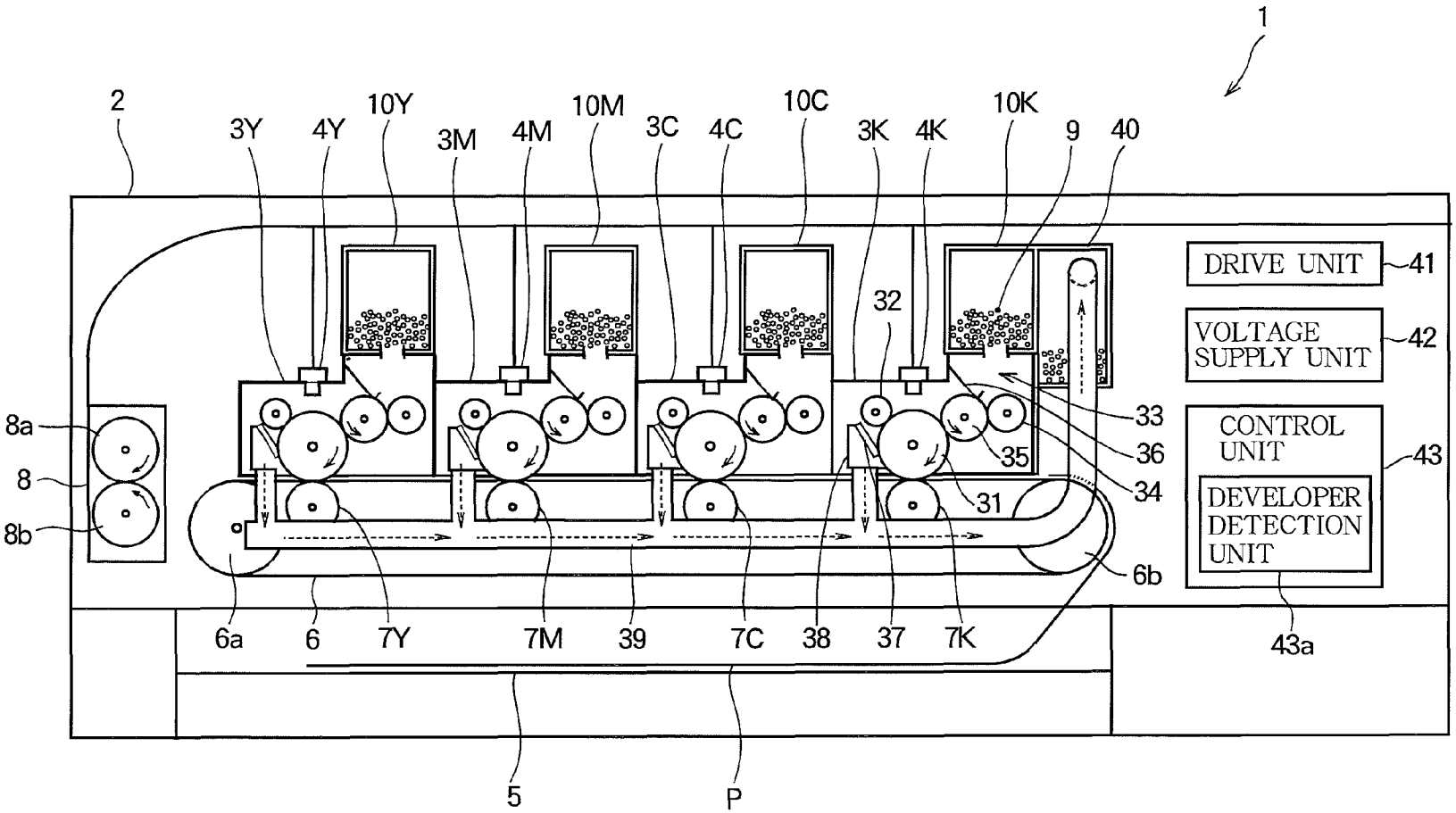
FIG. 1 is a diagram schematically illustrating basic structure of an image forming apparatus according a first embodiment.

FIG. 1 is a diagram schematically illustrating basic structure of an image forming apparatus 1 according to a first embodiment. The image forming apparatus 1 includes developing units 3K, 3C, 3M and 3Y each including a developer detection device to which the present invention is applied. In this embodiment, the image forming apparatus 1 is a tandem color LED printer. However, the image forming apparatus including the developer detection device may be another kind of apparatus, such as a photocopier, a facsimile, a multifunction peripheral (MFP), a monochrome printer or the like.

As illustrated in FIG. 1, the image forming apparatus 1 includes a housing 2; developing units 3K, 3C, 3M and 3Y (also referred to as a developing unit 3) for forming black (B), cyan (C), magenta (M) and yellow (Y) images respectively; exposure devices 4K, 4C, 4M and 4Y (also referred to as an exposure device 4) which perform exposure process based on image information of the black, yellow, magenta and cyan images; a paper-feed cassette 5; a paper-feeding mechanism (not illustrated in the drawing); an endless belt 6; a drive roller 6*a* and a tension roller 6*b* which extend the endless belt 6 in a tensioned state; transfer rollers 7K, 7C, 7M and 7Y (also referred to as a transfer roller 7); and a fixing device 8.

The image forming apparatus 1 further includes a drive unit 41 such as a motor, which provides a driving force to the developing units 3K, 3C, 3M and 3Y, the drive roller 6*a*, the paper-feed mechanism and other elements; a voltage supply unit 42 which applies voltages to the developing units 3K, 3C, 3M, 3Y, the transfer rollers 7K, 7C, 7M, 7Y and other elements; and a control unit 43 which controls operation of the whole apparatus including the drive unit 41 and the voltage supply unit 42. The control unit 43 includes a developer detection unit 43*a* which measures a time period during which a light-receiving unit 65 (described below) is receiving light having a level greater than a predetermined threshold level (referred to as a "light passing period" described below) and detects the amount of toner stored in an accommodating container responsive to a result of the measuring.

The developing units 3K, 3C, 3M and 3Y are aligned along a carrying passage for a recording medium P regulated in the housing 2. Each of the developing units 3K, 3C, 3M and 3Y is attachable to and detachable from a predetermined position in the housing 2 (e.g., in a basket 11 in FIG. 2 described below), and is also referred to as a "process unit" or an "image forming unit". In FIG. 1, a reference numeral 39 denotes a second carrying mechanism for carrying a waste toner and a reference numeral 40 denotes a waste toner accommodating container for storing the waste toner carried from the developing units 3K, 3C, 3M and 3Y by the second carrying mechanism 39.

The exposure devices 4K, 4C, 4M and 4Y are disposed near photosensitive bodies 31 in the developing units 3K, 3C, 3M and 3Y respectively. In FIG. 1, the exposure devices 4K, 4C, 4M and 4Y are disposed above the photosensitive bodies 31 respectively. Each of the exposure devices 4K, 4C, 4M and 4Y including an LED array (not illustrated in the drawing) is attached to an upper cover of the housing 2. The upper cover of the housing 2 is opened, when the developing units 3K, 3C, 3M, 3Y or developer cartridges (toner cartridges) 10K, 10C, 10M, 10Y (also referred to as a toner cartridge 10) which are installed in the developing units 3K, 3C, 3M, 3Y in the housing 2 are attached to or detached from the housing 2. The toner cartridges 10K, 10C, 10M and 10Y store unused toner 9 of corresponding colors: black, cyan, magenta and yellow, respectively. The toner cartridges 10K, 10C, 10M and 10Y are easily attachable to and detachable from the developing units 3K, 3C, 3M and 3Y, respectively.

The paper-feed cassette 5 for accommodating the recording medium (e.g., paper) P is attached at a lower position inside the housing 2 in a detachable manner. The paper-feed mechanism has a paper-feeding roller (not illustrated in the drawing) which feeds the recording medium P stacked on the paper-feed cassette 5 to the carrying passage one by one. The paper-feed mechanism may have a resist roller (not illustrated in the drawing) which feeds the developing units 3K, 3C, 3M and 3Y with the recording medium P with correcting its skew.

The endless belt 6 is moved by rotation of the drive roller 6*a*. The endless belt 6 holds the recording medium P on its surface by absorption, is moved by the rotation of the drive roller 6*a*, and carries the recording medium P along the developing units 3K, 3C, 3M and 3Y.

Each of the transfer rollers 7K, 7C, 7M and 7Y is disposed opposite the photosensitive body 31 in each of the developing units 3K, 3C, 3M and 3Y. A bias voltage for transferring a developer image (toner image) formed on each of surfaces of the photosensitive bodies 31 onto the recording medium P is applied to the transfer rollers 7K, 7C, 7M and 7Y. The transfer rollers transfer the toner image formed on the photosensitive body 31 in each of the developing units 3K, 3C, 3M and 3Y onto the recording medium P.

The fixing device 8 includes a heating roller 8*a* and a pressing roller 8*b*, whereby the recording medium P having the toner image before fixing is heated and pressed between the heating roller 8*a* and the pressing roller 8*b*, and thus the toner image is fixed to the recording medium P. Furthermore, shapes and arrangement of the elements in the image forming apparatus 1 are not limited to the illustrated example.

Figure 2:
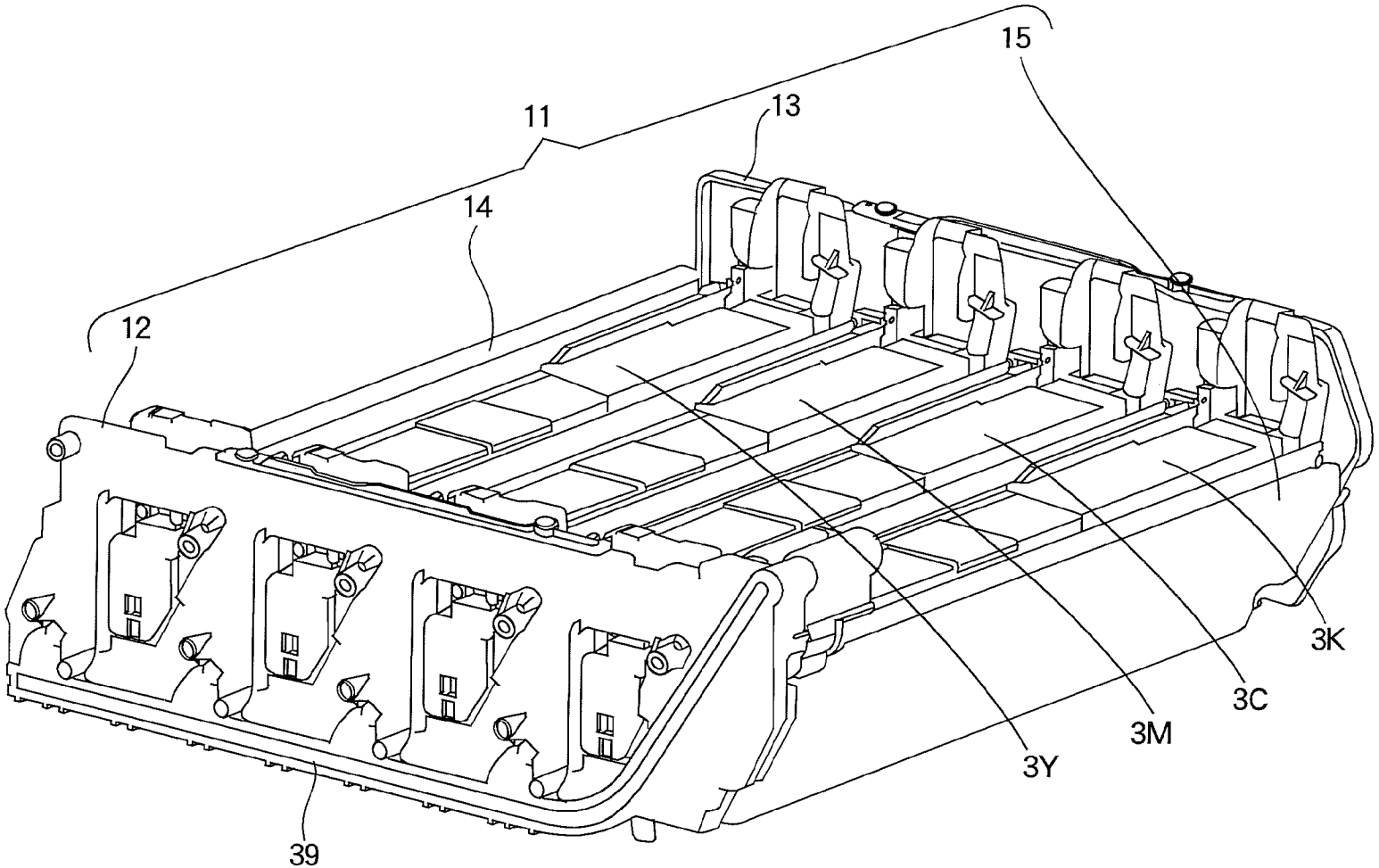
FIG. 2 is a perspective view schematically illustrating a basket which contains a plurality of developing units and is incorporated in the image forming apparatus of FIG. 1.

FIG. 2 is a perspective view schematically illustrating the basket 11 in the image forming apparatus 1 of FIG. 1, in which the plurality of developing units 3K, 3C, 3M and 3Y are installed. The basket 11 contains a first side frame 12, a second side frame 13, a front frame 14 and a rear frame 15. The developing units 3K, 3C, 3M and 3Y are orderly disposed in positions regulated by the basket 11 in order from a recording medium P supply side (on the right side in FIG. 2) to a recording medium P ejection side (on the left side in FIG. 2). Each of the developing units 3K, 3C, 3M and 3Y are easily attachable to and detachable from the basket 11. The second carrying mechanism 39 for carrying the waste toner to the waste toner accommodating container 40 is provided on the first side frame 12.

Next, the developing units 3K, 3C, 3M and 3Y will be explained. Since the developing units 3K, 3C, 3M and 3Y are the same in structure each other, the explanation will be directed at one of the developing units. As illustrated in FIG. 1, the developing unit 3 has the photosensitive body (photosensitive drum) 31 as an image carrier; a charging roller (charging device) 32 which uniformly charges the surface of the photosensitive body 31; a toner stirring chamber 33 which is an accommodating container for storing the toner supplied from the toner cartridge; a supplying roller 34 which is disposed in the toner stirring chamber 33; a developing roller 35 as a developer carrier which develops an electrostatic latent image on the surface of the photosensitive body 31 by the toner supplied from the supplying roller 34; a developing blade (developer regulating member) 36 which regulates a toner layer on the developing roller 35; a cleaning blade 37 which removes a residual toner remaining on the surface of the photosensitive body 31; and a first carrying mechanism 38 which carries a waste toner to the second carrying mechanism 39. The structure, shape and arrangement of the developing unit 3 are not limited to the example illustrated in FIG. 1 and FIG. 2.

The photosensitive body 31 includes a cylindrical conductive base layer made of aluminum or the like, and includes an outer layer which is made of an organic photosensitive body and covers an outer circumference of the conductive base layer, for example. The charging roller 32 is a roller-shaped member which includes a conductive metal shaft and a semiconducting rubber layer which is made of epichlorohydrin rubber or the like and covers an outer circumference of the metal shaft, for example. The charging roller 32 is in contact with the surface of the photosensitive body 31 and is driven to rotate by the photosensitive body 31.

The developing roller 35 includes, for example, a conductive metal shaft, and a semiconducting rubber layer which is made of silicon or the like and covers an outer circumference of the metal shaft. The supplying roller 34 includes, for example, a conductive metal shaft, and a semiconducting rubber layer which is made of silicon or the like and covers an outer circumference of the metal shaft. The semiconducting rubber layer of the supplying roller 34 is formed by adding a foaming agent at a time of kneading rubber in order to improve developer carrying performance. The developing roller 36 is a member for regulating a thin toner layer to have an even thickness on the developing roller 35. The developing blade 36 and the supplying roller 34 are disposed so as to be in contact with the developing roller 35.

The cleaning blade 37 is strongly adhered to a bracket of the developing unit 3 by means of hot-melt adhesive or the like. The charging roller 32, the developing roller 35 and the cleaning blade 37 are disposed so as to be in contact with the photosensitive body 31. The first carrying mechanism (waste toner carrying member) 38 which is a spiral spring, a coil spring, or the like and extends in an axial direction of the photosensitive body 31 (i.e., in a direction perpendicular to a sheet on which FIG. 1 is illustrated) is disposed below the cleaning blade 37. The first carrying mechanism 38 carries the waste toner to the second carrying mechanism 39 in the axial direction of the photosensitive body 31 (i.e., in a direction perpendicular to the sheet on which FIG. 1 is illustrated and toward a front of the sheet). The waste toner carried by the first carrying mechanism 38 is carried to the waste toner accommodating container 40 by the second carrying mechanism 39.

The photosensitive body 31, the charging roller 32, the developing roller 35 and the supplying roller 34 rotate in directions indicated by arrows in FIG. 1, by a driving force from the drive unit 41 which includes a driving force transmission mechanism such as a motor and gears. Bias voltages are applied to the developing roller 35, the supplying roller 34 and the developing blade 36 by the voltage supply unit 42 which includes a developing roller power supply, a supplying roller power supply, a developing blade power supply, and the like.

A rotation shaft supporting the photosensitive body 31 and another rotation shaft supporting the charging roller 32 are rotatably supported by members on either sides of the photosensitive body 31 in its axial direction. The developing roller 35, the supplying roller 34 and the developing blade 36 are also supported by the members on either sides of the photosensitive body 31 in its axial direction.

Each of the toner cartridges 10K, 10C, 10M and 10Y includes an accommodating container for storing unused toner 9 of corresponding colors. The toner cartridges 10K, 10C, 10M and 10Y are attached in upper parts of the corresponding developing units 3K, 3C, 3M and 3Y, respectively. The toner cartridges 10K, 10C, 10M and 10Y are easily attachable to and detachable from the corresponding developing units 3K, 3C, 3M and 3Y, respectively. In the first embodiment, the developing units 3K, 3C, 3M and 3Y, the basket 11, the toner cartridge 10 and the waste toner accommodating container 40 are individually replaceable units which are exchanged when there is little toner after toner consumption or when degradation in performance occurs in any parts or the like.

<Developing Unit>

Figure 3:
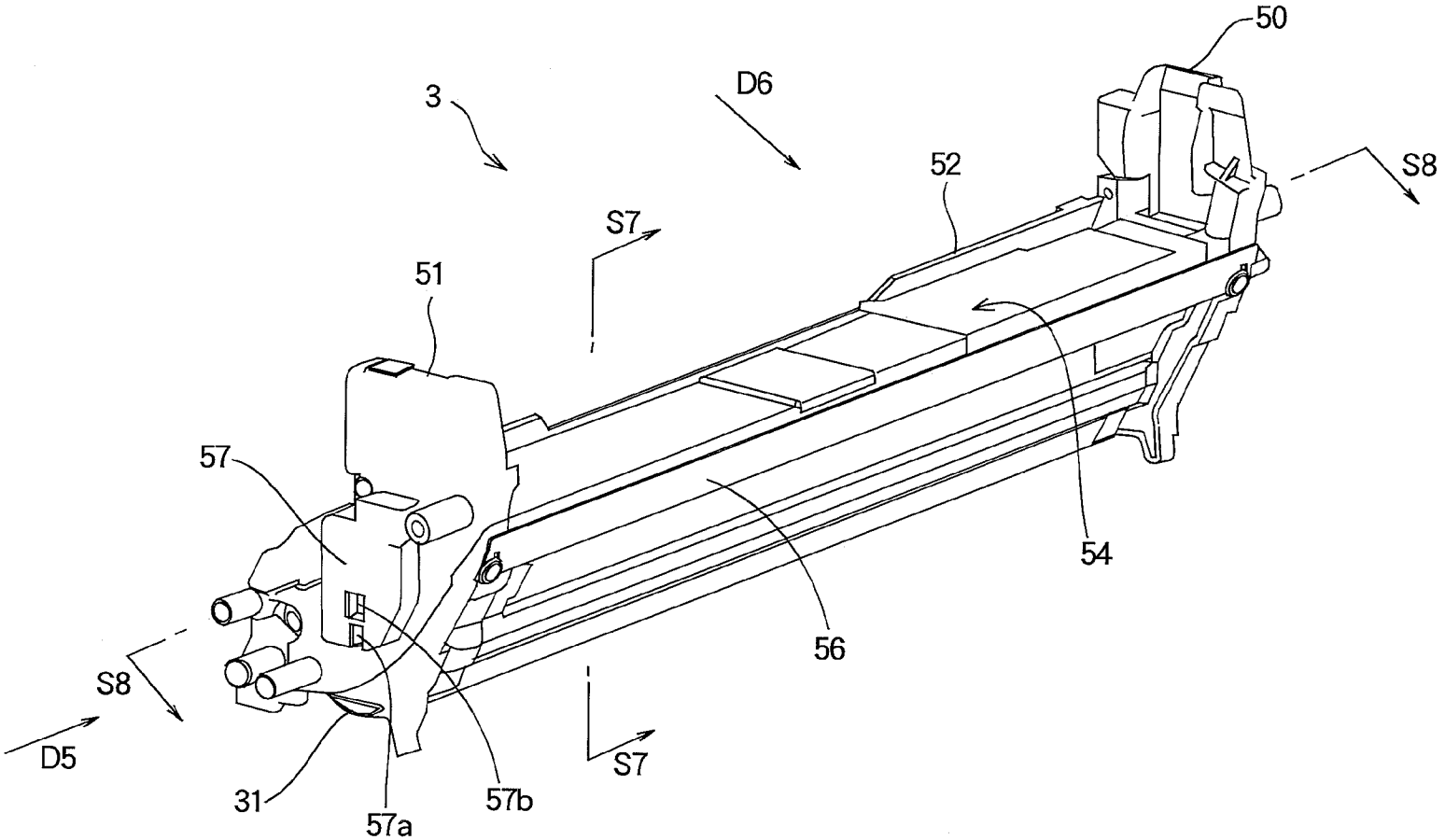
FIG. 3 is an external perspective view schematically illustrating any of the developing units which is to be installed in the basket of FIG. 2.
Figure 4:
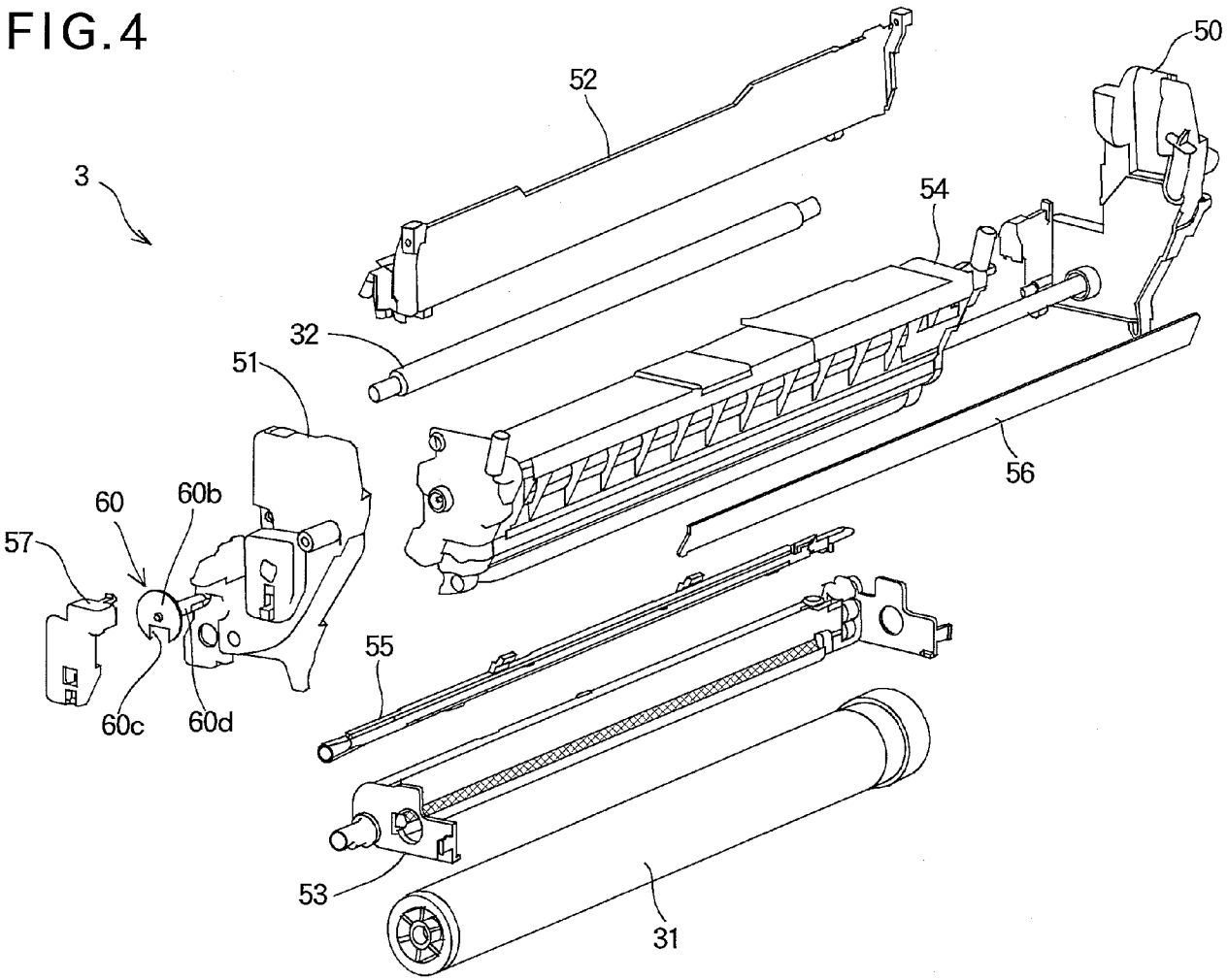
FIG. 4 is an exploded perspective view schematically illustrating the developing unit of FIG. 3.
Figure 5:
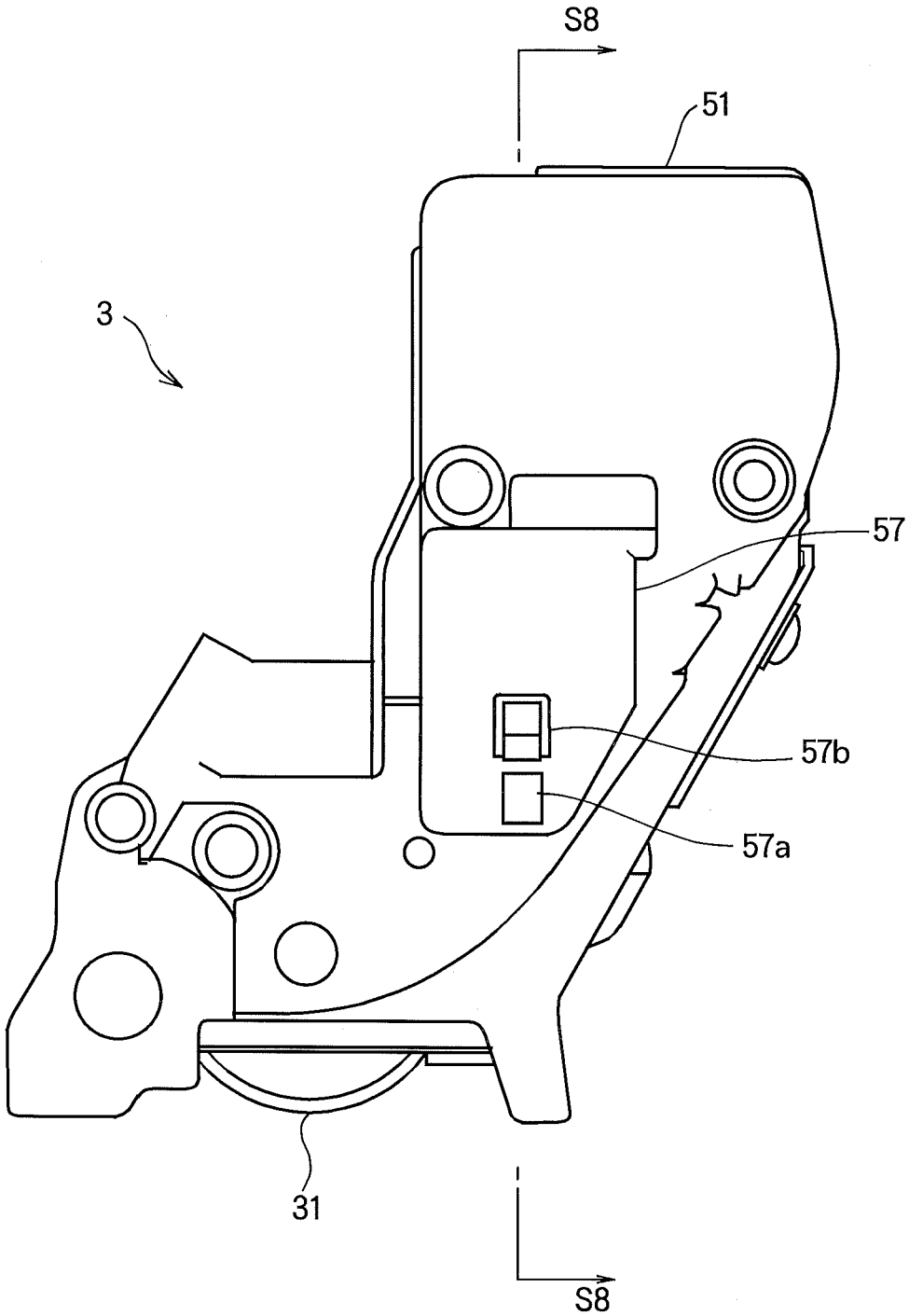
FIG. 5 is a side view schematically illustrating the developing unit of FIG. 3 taken in a D5 direction.
Figure 6:
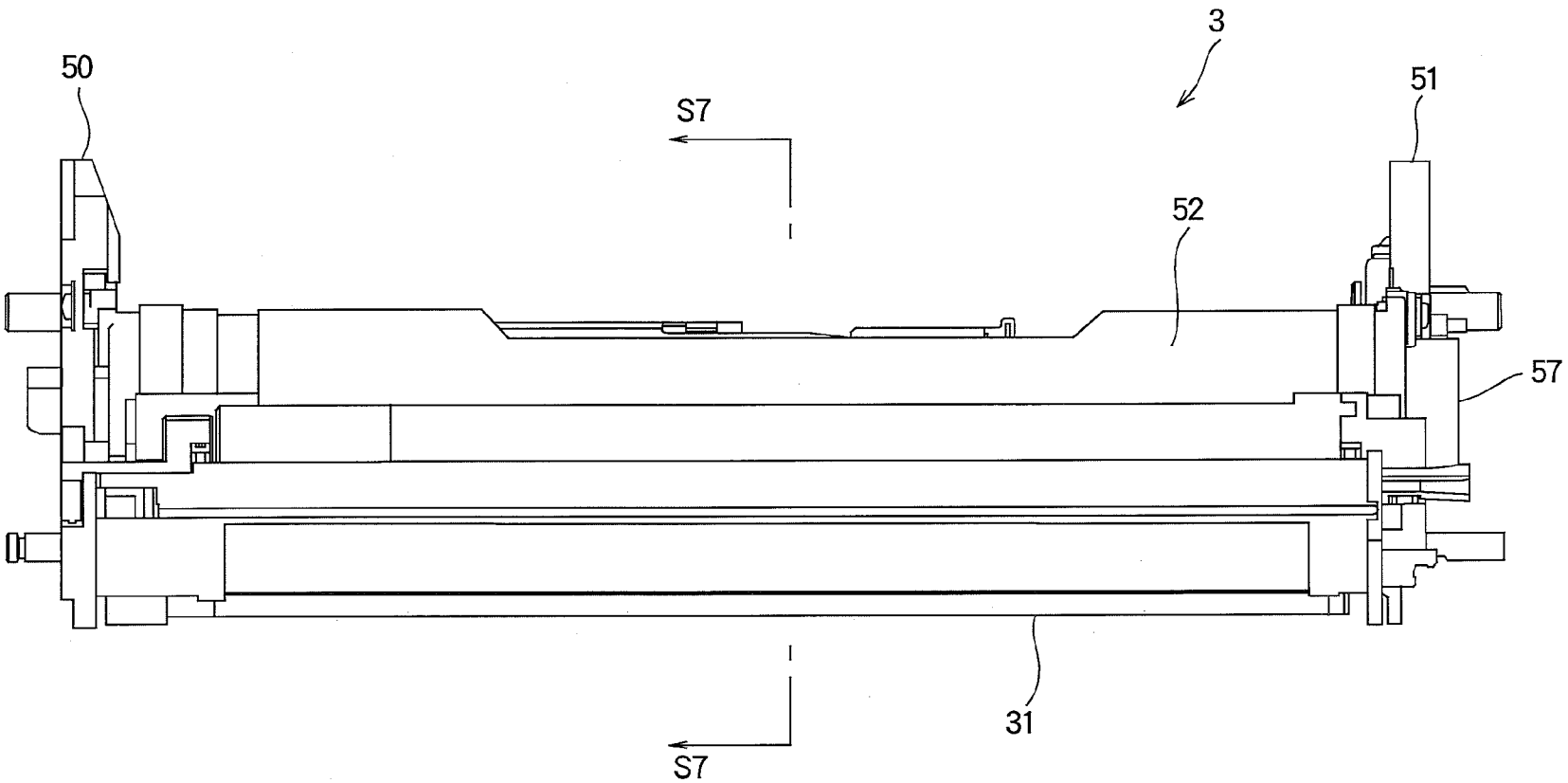
FIG. 6 is a back view schematically illustrating the developing unit of FIG. 3 taken in a D6 direction.
Figure 7:
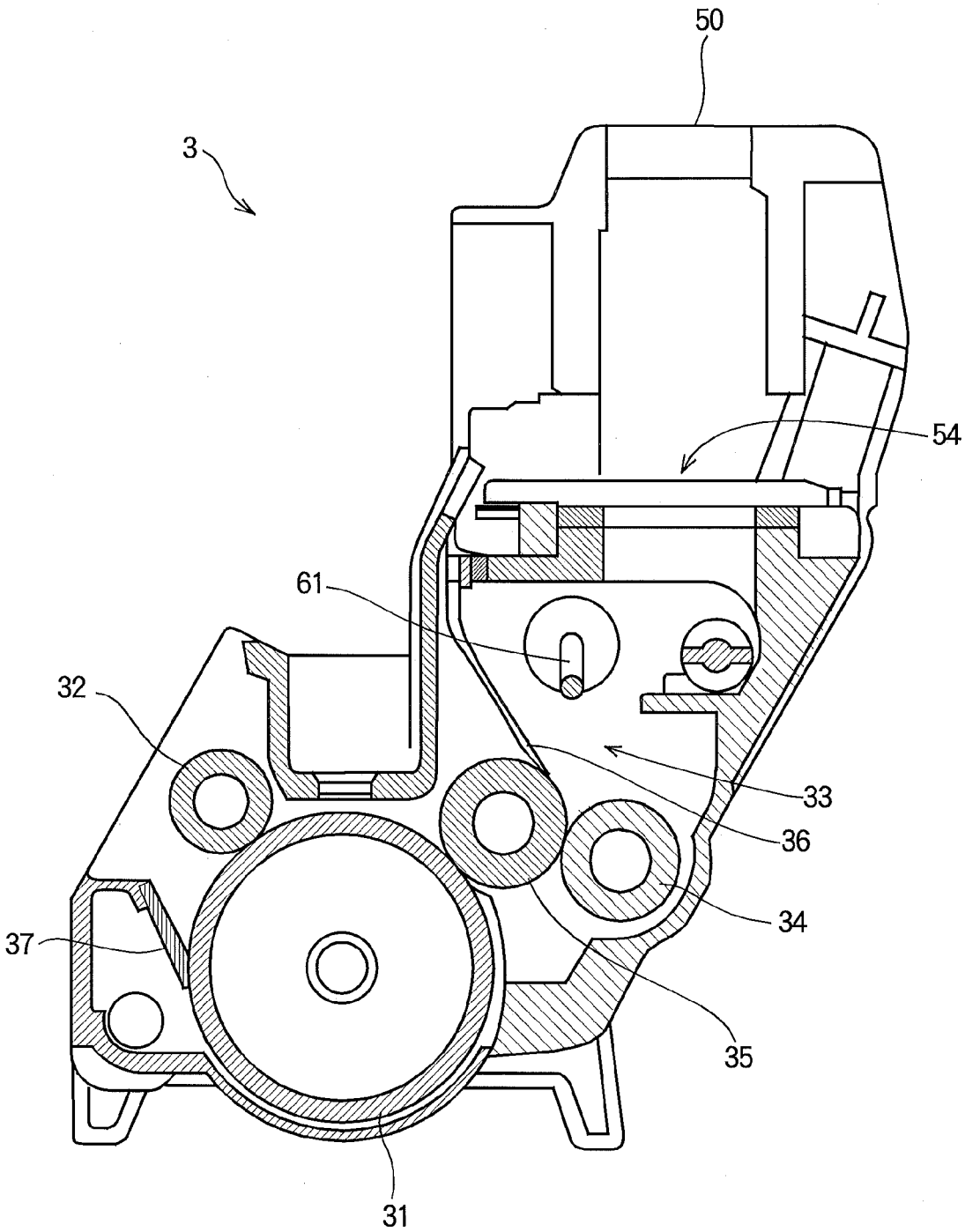
FIG. 7 is a longitudinal sectional view schematically illustrating a cross-section taken along an S7-S7 line in FIG. 6.

FIG. 3 is an external perspective view schematically illustrating the developing unit 3 which includes the developer detection device according to the first embodiment; and FIG. 4 is an exploded perspective view schematically illustrating the developing unit 3 of FIG. 3. FIG. 5 is a side view showing the developing unit 3 of FIG. 3 taken in a D5 direction; and FIG. 6 is a backside view showing the developing unit 3 of FIG. 3 taken in a D6 direction. FIG. 7 is a longitudinal sectional view illustrating a cross-section taken along a S7-S7 line in FIG. 3 or FIG. 6; and FIG. 8 is a longitudinal sectional view illustrating a cross-section taken along a S8-S8 line in FIG. 3 or FIG. 5.

Figure 8:
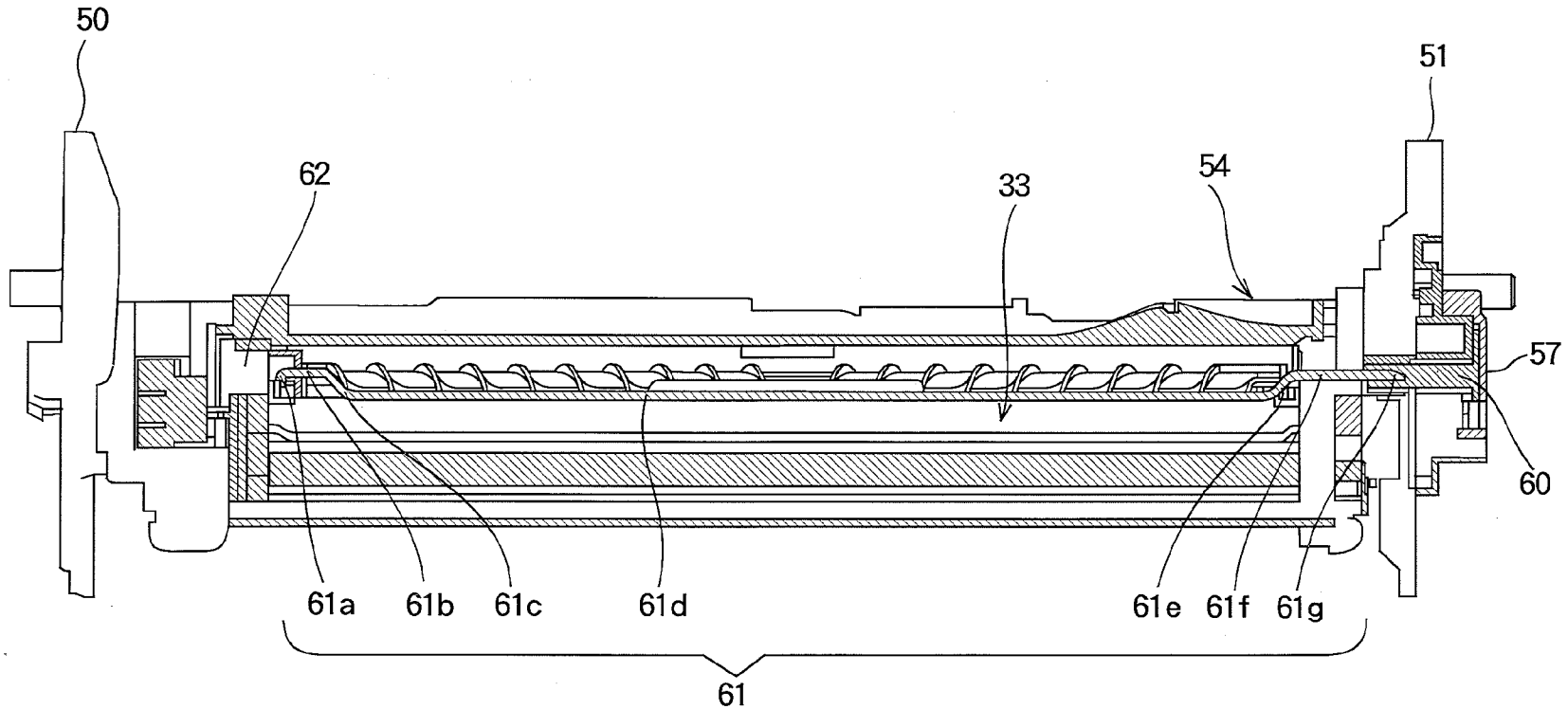
FIG. 8 is a longitudinal sectional view schematically illustrating a cross-section taken along an S8-S8 line in FIG. 5.

As illustrated in any of FIG. 3 to FIG. 8, the developing unit 3 includes a first side plate 50; a second side plate 51; an upper frame 52; a base frame 53; a developing assembly (developing Assy) 54; a destaticizing assembly (destaticizing Assy) 55; a reinforcing plate 56; and a plate cover 57. The developing unit 3 includes a detection plate 60, a stirring bar 61 and a stirring gear 62 which are main components of the developer detection device according to the first embodiment and which form a rotating member. As illustrated in FIG. 8, the stirring bar 61 is disposed in the toner stirring chamber 33 in the developing unit 3 so that a longitudinal direction of the stirring bar 61 is parallel to the axial direction of the photosensitive body 31. An end of the stirring bar 61 is joined to the stirring gear 62 and the other end of the stirring bar 61 is attached to the detection plate 60. The stirring bar 61 is made of metal, for example. Furthermore, the structure, shape and arrangement of the developing unit 3 are not limited to the example illustrated in FIG. 3 to FIG. 8.

<Structure of Developer Detection Device>

Figure 9:
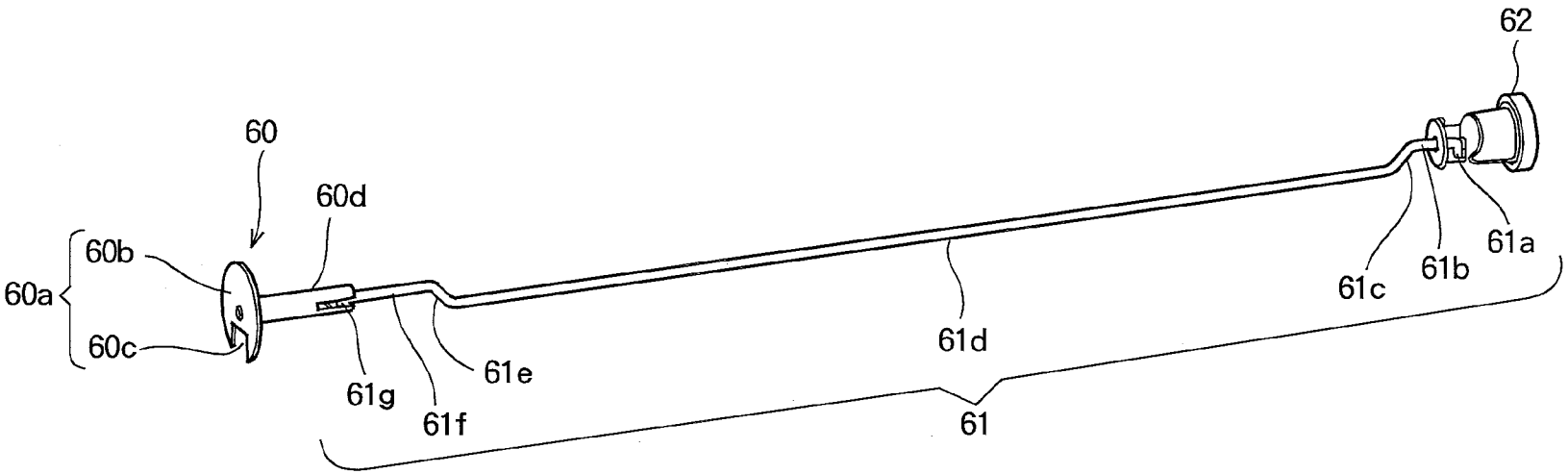
FIG. 9 is a perspective view schematically illustrating a stirring bar, a stirring gear and a detection plate, which are main components of the developer detection device according to the first embodiment.
Figure 10:
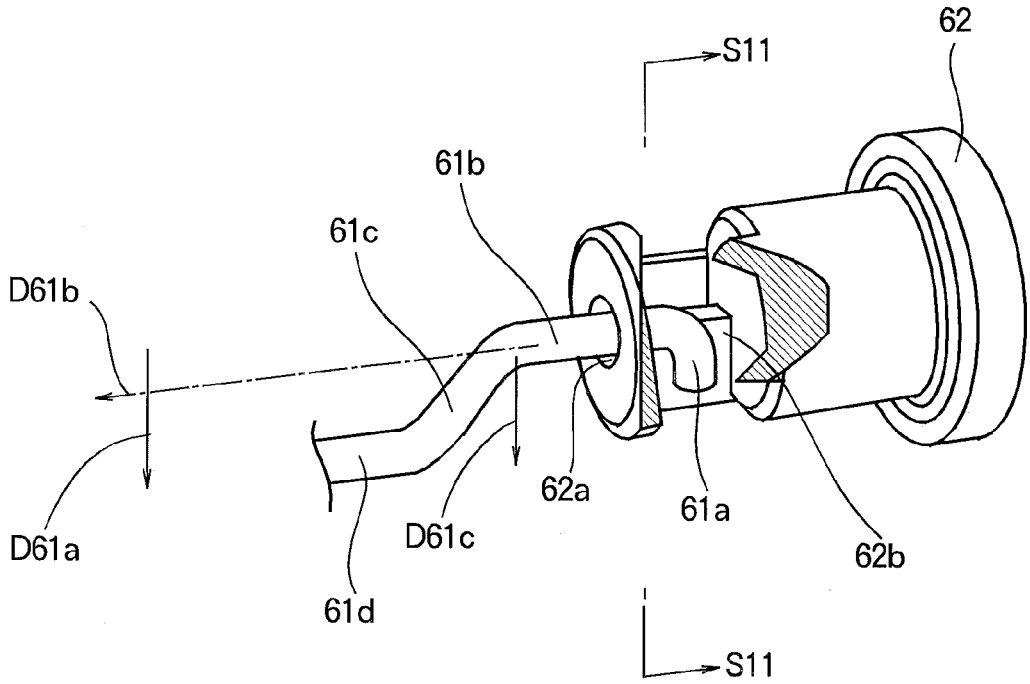
FIG. 10 is a partially cutaway perspective view schematically illustrating the stirring gear of FIG. 9 on a larger scale.
Figure 11:
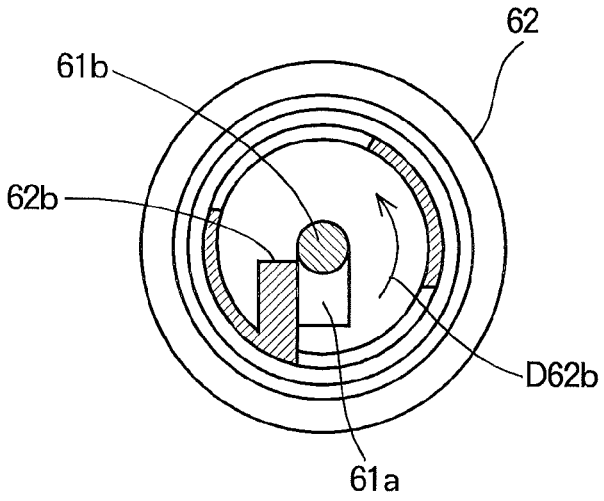
FIG. 11 is a longitudinal sectional view schematically illustrating a cross-section taken along an S11-S11 line in FIG. 10.
Figure 12:
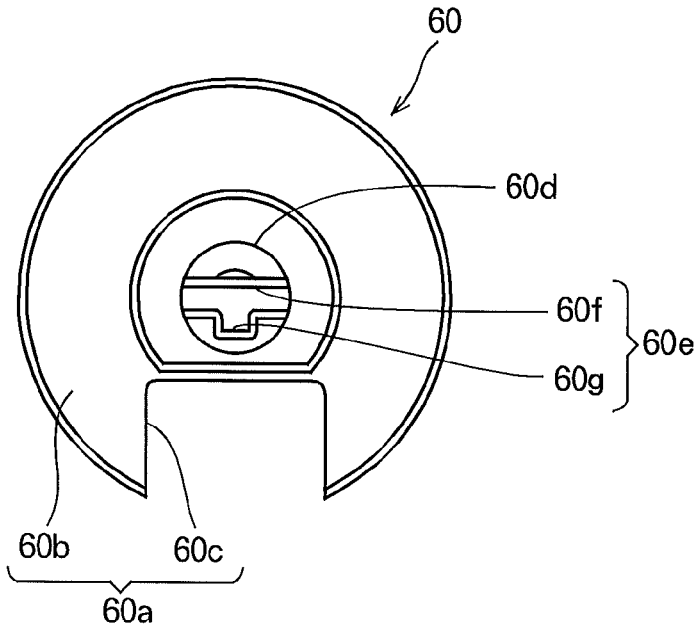
FIG. 12 is a front view schematically illustrating the detection plate of FIG. 9 on a larger scale.
Figure 13:
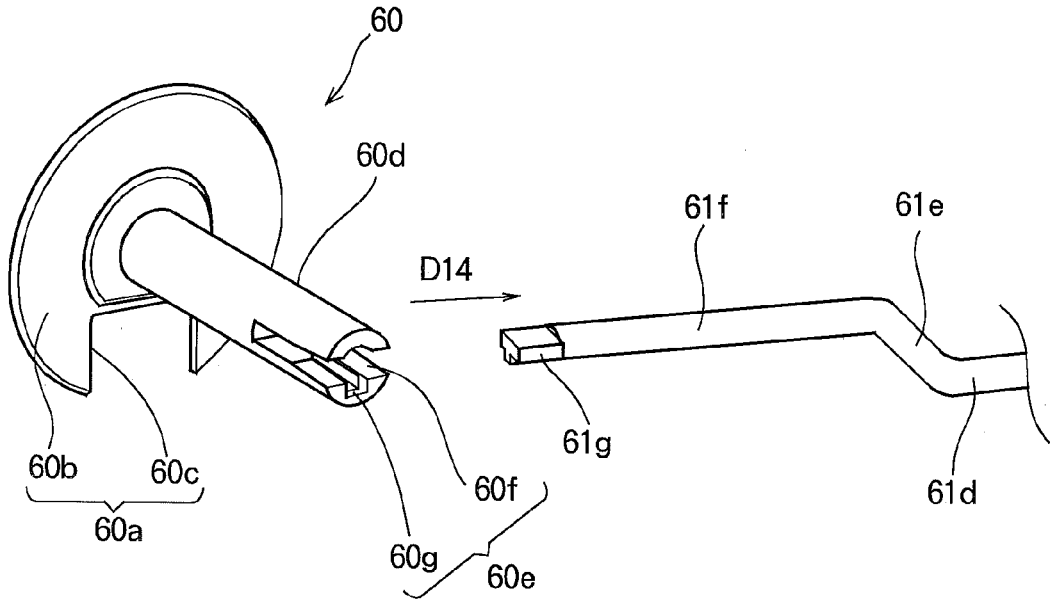
FIG. 13 is a perspective view schematically illustrating the detection plate and the stirring bar of FIG. 9 on a larger scale.
Figure 14:
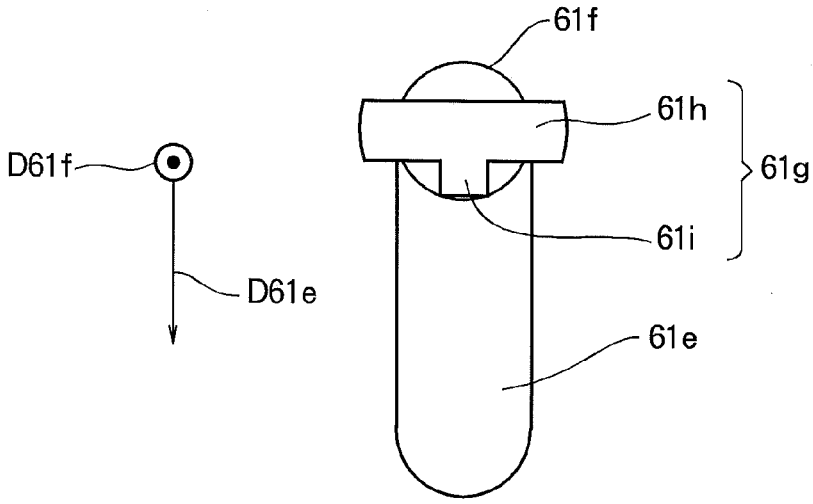
FIG. 14 is a side view schematically illustrating the stirring bar of FIG. 13 taken in a D14 direction on a larger scale.

FIG. 9 is a perspective view schematically illustrating the stirring bar 61, the stirring gear 62 and the detection plate 60 which are main components of the developer detection device according to the first embodiment. FIG. 10 is a partially cutaway perspective view illustrating the stirring gear 62 of FIG. 9 on a larger scale, and FIG. 11 is a sectional view illustrating a cross-section taken along a S11-S11 line in FIG. 10. FIG. 12 is a front view illustrating the detection plate 60 of FIG. 9 on a larger scale, and FIG. 13 is a perspective view illustrating the detection plate 60 of FIG. 9 on a larger scale. FIG. 14 is a side view illustrating the stirring bar of FIG. 13 taken in a D14 direction on a larger scale.

As illustrated in any of FIG. 9 to FIG. 14, the stirring bar 61 includes a rotation driven part 61*a*, a first rotation shaft part 61*b*; a first sloped part 61*c*; a stirring part 61*d*; a second sloped part 61*e*; a second rotation shaft part 61*f*; and an engagement part 61*g*.

The first sloped part 61*c* which extends in a direction crossing an axial line of the first rotation shaft part 61*b* is provided on a side closer to the detection plate 60 from the first rotation shaft part 61*b* of the stirring bar 61. The rotation driven part 61*a* which extends in a direction crossing the axial line of the first rotation shaft part 61*b* is provided on a side closer to the stirring gear 62 from the first rotation shaft part 61*b* of the stirring bar 61. The rotation driven part 61*a* of the stirring bar 61 is formed by bending an edge of the first rotation shaft part 61*b* about 90°, for example. The stirring bar 61 is formed so that a direction in which the rotation driven part 61*a* of the stirring bar 61 is bended (a D61*a* direction in FIG. 10) and a movement direction in which the first sloped part 61*c* moves the stirring part 61*d* (a D61*c* direction in FIG. 10) are the same direction starting from the first rotation shaft part 61*b*.

An axial line of the second rotation shaft part 61*f* agrees with an axial line of the first rotation shaft part 61*b*. There is the second sloped part 61*e* which extends in a direction crossing the axial line of the second rotation shaft part 61*f* on a side closer to the stirring gear 62 of the second rotation shaft part 61*f*, and there is the engagement part 61*g* on the other side closer to the detection plate 60 of the second rotation shaft part 61*f*. The second sloped part 61*e* and the first sloped part 61*c* are formed so as to be included in the same plane and to be symmetrical around the stirring part 61*d*. The first rotation shaft part 61*b*, the first sloped part 61*c*, the stirring part 61*d*, the second rotation shaft part 61*f*, the second sloped part 61*e* and the rotation driven part 61*a* are formed so as to be included in the same plane.

As illustrated in FIG. 14, the engagement part 61*g* of the stirring bar 61 has a base section 61*h* which has a flat plate shape and a projection section 61*i* which projects from the base section 61*h* in a direction perpendicular to the axial line, for example. The base section 61*h* is formed so as to extend from an edge of the second rotation shaft part 61*f* in an axial direction of the second rotation shaft part 61*f*. Further, the base section 61*h* is formed so as to be laid on a line extended from the axial line of the second rotation shaft part 61*f*. The projection section 61*i* is formed to be approximately orthogonal to the axial line of the second rotation shaft part 61*f* and to extend in an approximately-orthogonal direction to a main surface of the base section 61*h*. For example, the engagement part 61*g* can be formed to have a shape like the letter "T" by pressing. The shape of the engagement part 61*g* of the stirring bar 61 may be another shape capable of being connected with the detection plate 60.

As illustrated in FIG. 9, the stirring bar 61 has the stirring part 61*d* between the first sloped part 61*c* and the second sloped part 61*e*. A center line extending in a longitudinal direction of the stirring part 61*d* is approximately parallel to the axial lines of the first rotation shaft part 61*b* and the second rotation shaft part 61*f*. Accordingly, the first rotation shaft part 61*b*, the first sloped part 61*c*, the stirring part 61*d*, the second sloped part 61*e* and the second rotation shaft part 61*f* has a crank-like shape. Rotating the stirring bar 61 around the axial lines of the first rotation shaft part 61*b* and the second rotation shaft part 61*f* causes the first sloped part 61*c*, the second sloped part 61*e*, and the stirring part 61*d* to move outside of the first rotation shaft part 61*b* and the second rotation shaft part 61*f* and thus stirs toner stored in the toner stirring chamber 33. The structure, shape and arrangement of the stirring bar 61 are not limited to the illustrated example.

The stirring gear 62 receives a driving force from the drive unit 41 through a driving force transmitting mechanism (not illustrated in the drawings) such as a gear, thereby rotating the stirring bar 61. As illustrated in FIG. 10, the stirring gear 62 includes a bearing part 62*a* and a rotation driving rib 62*b*, for example. The bearing part 62*a* of the stirring gear 62 rotatably supports the first rotation shaft part 61*b* of the stirring bar 61. Since the rotation driving rib 62*b* of the stirring gear 62 is in contact with the rotation driven part 61*a* of the stirring bar 61, rotation of the stirring gear 62 causes the stirring bar 61 to rotate. For example, as illustrated in FIG. 11, the stirring gear 62 rotates in a D62*b* direction, then the rotation driving rib 62*b* of the stirring gear 62 presses the rotation driven part 61*a* of the stirring bar 61 in the D62*b* direction and causes the stirring bar 61 to rotate in a D62*b* direction.

The detection plate 60 rotates with the stirring bar 61, and the detection plate 60 makes light from the light-emitting unit (reference numeral 64 described below) pass through a light-passing section (reference numeral 60*c* described below) without blocking the light when the stirring part 61*d* of the stirring bar 61 is in a predetermined position. As illustrated in FIG. 13, the detection plate 60 has a disc-shaped part 60*a* and a bar connecting part 60*d*, for example. The disc-shaped part 60*a* of the detection plate 60 made of an approximately circular plate-like member has a light-blocking section 60*b* and the light-passing section 60*c*. The light-passing section 60*c* of the detection plate 60 is formed by cutting out a part closer to a circumference of the approximately circular disc-shaped part 60*a*, for example. The light-blocking section 60*b* is formed so that its area is larger than an area of the cut out part for providing the light-passing section 60*c*, if the disc-shaped part 60*a* is assumed to be circular. Thereby, for example, when the detection plate 60 rotates at an even speed, a time period during which the light-blocking section 60*b* is blocking light is longer than a time period during which light is passing through the light-passing section 60*c*.

The bar connecting part 60*d* of the detection plate 60 is formed by a cylindrical-shaped member and extends in a direction orthogonal to a plane including the disc-shaped part 60*a*. An axial line of the bar connecting part 60*d* agrees with the center of the disc-shaped part 60*a*. At its edge, the bar connecting part 60*d* of the detection plate 60 has an insertion receiving part 60*e* into which the engagement part 61*g* illustrated in FIG. 14 is inserted. As illustrated in FIG. 12, the insertion receiving part 60*e* of the detection plate 60 has a first slot section 60*f* with which the base section 61*h* of the engagement part 61*g* engages and a second slot section 60*g* with which the projection section 61*i* of the engagement part 61*g* engages. The first slot section 60*f* which extends from the edge of the bar connecting part 60*d* toward the disc-shaped part 60*a* is an aperture from a circumferential surface of the bar connecting part 60*d* to another circumferential surface opposite side of the axial line of the bar connecting part 60*d*. The first slot section 60*f* of the insertion receiving part 60*e* has a shape and a size which enable the base section 61*h* illustrated in FIG. 14 to fit therein. The second slot section 60*g* of the insertion receiving part 60*e* is an aperture which extends from the first slot section 60*f* in a direction orthogonal to axial lines of the first slot section 60*f* and the bar connecting part 60*d*. The second slot section 60*g* does not reach the circumferential surface of the bar connecting part 60*d*. The second slot section 60*g* has a shape and a size which enable the projection section 61*i* in FIG. 14 to fit therein. FIG. 12 illustrates that the detection plate 60 includes the light-passing section 60*c* on a lower side in FIG. 12 and includes the second slot section 60*g* on a lower side in FIG. 12. The bar connecting part 60*d* of the detection plate 60 may have another structure and another shape capable of being connected to the stirring bar 61. The structure and shape of the disc-shaped part 60*a* of the detection plate 60 are not limited to the illustrated example.

Figure 15:
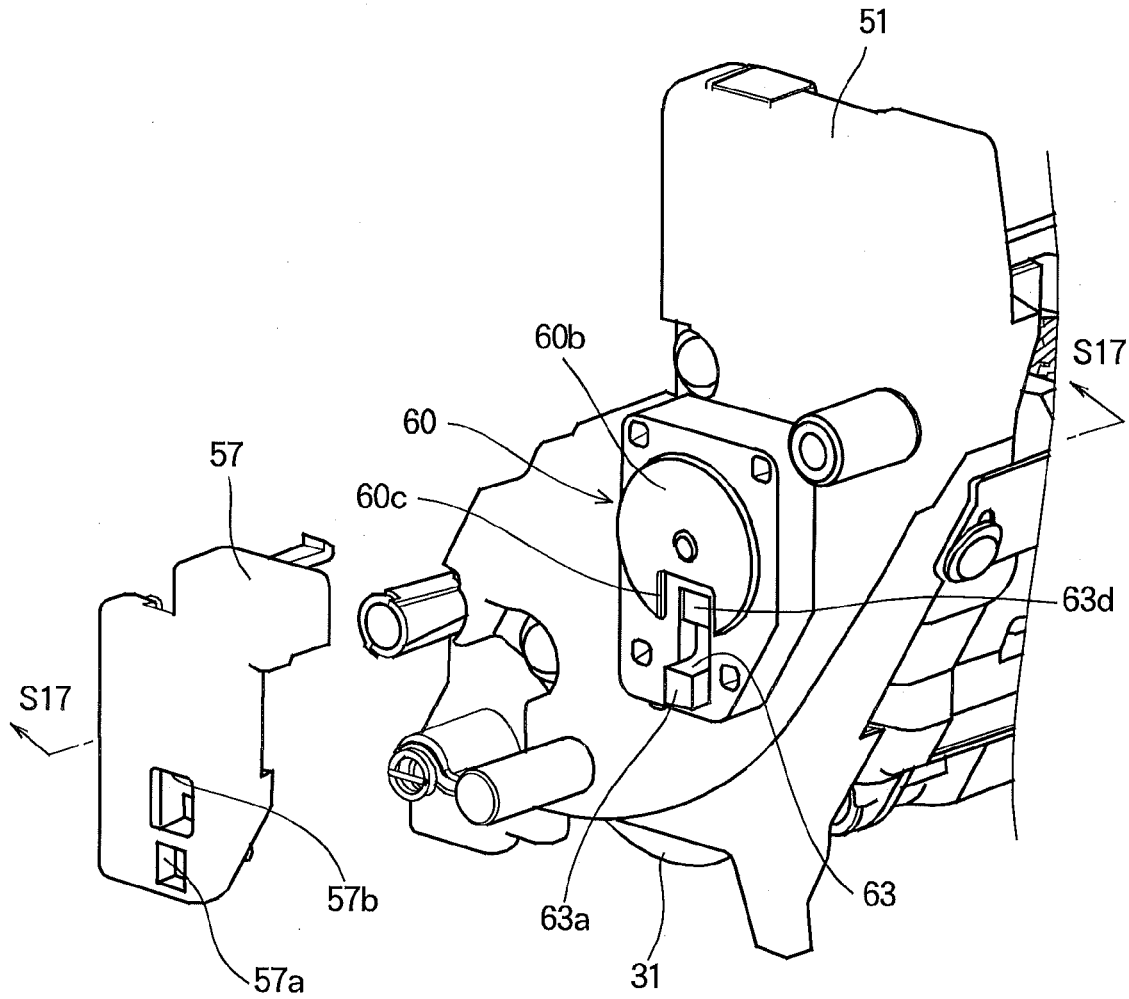
FIG. 15 is a perspective view schematically illustrating the developing unit of FIG. 3 when a plate cover is taken off.
Figure 16:
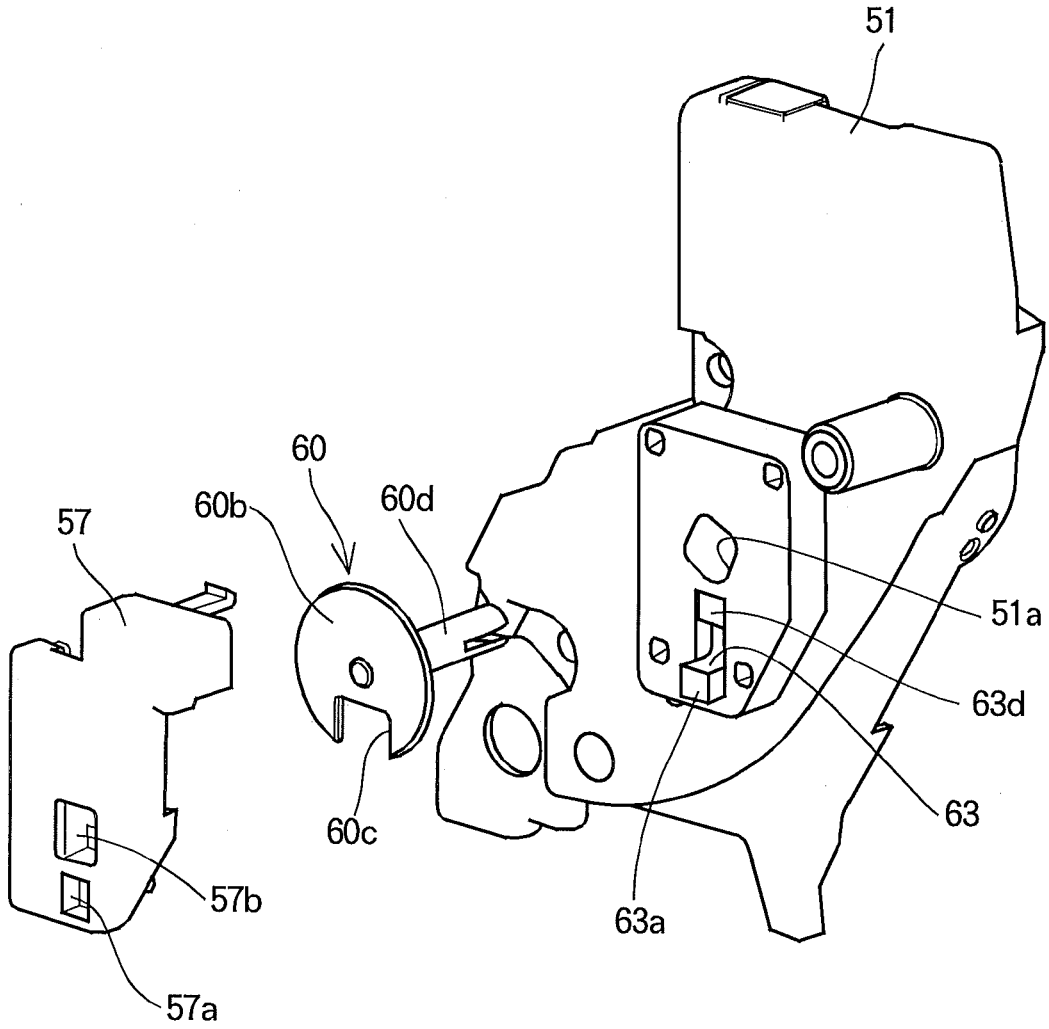
FIG. 16 is a perspective view schematically illustrating the developing unit of FIG. 15 when the detection plate is taken off.
Figure 17:
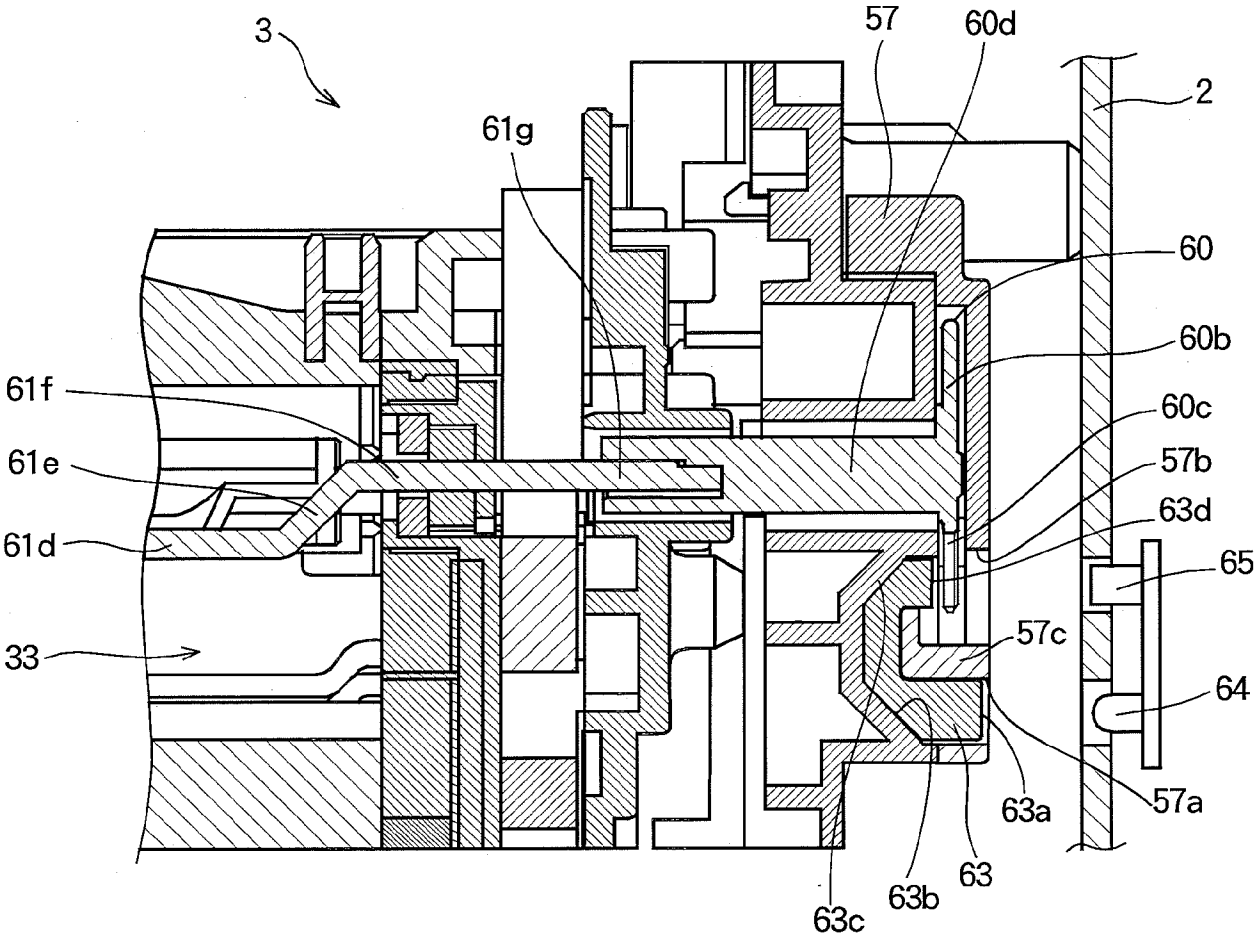
FIG. 17 is a longitudinal sectional view schematically illustrating structure on a side of a second side plate when the developing unit of FIG. 3 is installed in a housing of the image forming apparatus.

FIG. 15 is a perspective view schematically illustrating the developing unit 3 in FIG. 3 when the plate cover 57 is taken off. FIG. 16 is a perspective view schematically illustrating the developing unit 3 in FIG. 15 when the detection plate 60 is taken off. Furthermore, FIG. 17 is a longitudinal sectional view schematically illustrating structure on a side of the second side plate 51 when the developing unit 3 in FIG. 3 is installed in the housing 2 and is the sectional view illustrating a cross-section taken along a S17-S17 line in FIG. 15.

As illustrated in FIG. 15, the detection plate 60 is covered by the plate cover 57, and the detection plate 60 has a detection light guide 63 in a lower part thereof. As illustrated in FIG. 16, the second side plate 51 has an opening 51*a* for being inserted by the bar connecting part 60*d* of the detection plate 60. An inside diameter of the opening 51*a* is larger than an outer diameter of the bar connecting part 60*d*. By inserting the bar connecting part 60*d* into the opening 51*a*, the detection plate 60 is supported rotatably around the axial line of the bar connecting part 60*d*. Furthermore, the detection light guide 63 is disposed below the opening 51*a*.

The detection light guide 63 receives incident light on a light entrance section 63*a* and emits the light from a light exit section 63*d*. Referring to FIG. 17, the detection light guide 63 is a prism made of a transparent medium such as glass or crystal, for example, having the light entrance section 63*a*, a first reflection surface 63*b*, a second reflection surface 63*c* and the light exit section 63*d*. The light entrance section 63*a* and the light exit section 63*d* are parallel surfaces facing the same direction. The first reflection surface 63*b* is sloped at an angle of 45° with respect to the light entrance section 63*a* so as to direct the incident light from the light entrance section 63*a* to the second reflection surface 63*c* (e.g., to bend the light 90°). The second reflection surface 63*c* is sloped at an angle of 45° with respect to the light exit section 63*d* so as to direct the light from the first reflection surface 63*b* to the light exit section 63*d* (e.g., to bend the light 90°). The first reflection surface 63*b* and the second reflection surface 63*c* are at an angle of 90°, for example. The incident light on the light entrance section 63*a* is totally reflected by the first reflection surface 63*b* and the second reflection surface 63*c* and then emits from the light exit section 63*d*. The structure of the detection light guide 63 is not limited to the illustrated example, and an optical member having different structure may be used as long as the optical member can direct the incident light in a desired direction.

The plate cover 57 includes an entrance window 57*a*, an exit window 57*b* and a detection light guide rib 57*c*. The entrance window 57*a* and the exit window 57*b* are openings through which light passes. When the plate cover 57 is attached to the second side plate 51, the entrance window 57*a* faces the light entrance section 63*a*, and the exit window 57*b* faces the light exit section 63*d* of the detection light guide 63. The entrance window 57*a* and the exit window 57*b* are formed so as to be larger than the light entrance section 63*a* and the light exit section 63*d* of the detection light guide 63, when the plate cover 57 is attached to the second side plate 51. In other words, it is desirable that the entrance window 57*a* and the exit window 57*b* should have such a shape and a size that the plate cover 57 does not cover the light entrance section 63*a* and the light exit section 63*d* of the detection light guide 63, when the plate cover 57 is attached to the second side plate 51. The detection light guide rib 57*c* determines positions of the entrance window 57*a* and the exit window 57*b* with respect to the detection light guide 63, when the plate cover 57 is attached to the second side plate 51.

In the housing 2, a detecting unit including the light-emitting unit 64 and the light-receiving unit 65 are installed. The detecting unit measures a time period, during which light emitted from the light-emitting unit and passing through the light-passing section is being received by the light-receiving unit, thereby detecting an amount of the developer stored in the accommodating container on the basis of a result of the measuring. As illustrated in FIG. 17, when the developing unit 3 is installed in the housing 2, the entrance window 57*a* and the light entrance section 63*a* face the light-emitting unit 64, and the exit window 57*b* and the light exit section 63*d* of the detection light guide 63 face the light-receiving unit 65. When light emitted from the light-emitting unit 64 enters the light entrance section 63*a* of the detection light guide 63, the incident light emits from the light exit section 63*d* and is received at the light-receiving unit 65. The detection plate 60 is disposed so that the emitted light from the light exit section 63*d* is blocked at the light-blocking section 60*b* or passed through the light-passing section 60*c*. The light-emitting unit 64 may be a light-emitting element or an optical member for guiding light from the light-emitting element and illuminating. The light-receiving unit 65 may be a light-receiving element or an optical member for guiding light to the light-receiving element by using a guiding member such as an optical guide. While the light-receiving element is detecting light, the light-receiving unit 65 supplies a detection signal of a signal level depending on a receiving light amount to the control unit 43. Receiving the detection signal, the control unit 43 measures a time period during which the detection signal is being received from the light-receiving unit 65 (i.e., light-passed period) and determines that the amount of toner stored in the toner stirring chamber 33 decreases, if the time period is equal to or longer than a predetermined time (i.e., threshold). By providing each of the developing units 3K, 3C, 3M and 3Y with a pair of the light-emitting unit 64 and the light-receiving unit 65, the remaining amount of toner for each color can be determined by the control unit 43.

As described above, the rotating member has the detection plate 60 and the stirring bar 61, the developer detection device according to the first embodiment includes the detection plate 60 as a first part which has the light-blocking section 60*b* and the light-passing section 60*c* and is rotatably supported; the stirring bar 61 as a second part which is connected to the detection plate 60 and temporarily stops rotating at a rotation position corresponding to a position of an upper surface 9*a* of the toner 9 stored in the toner stirring chamber 33 which is the accommodating container; the stirring gear 62 as a rotation driving member which gives a force for pressing the stirring bar 61 in a predetermined rotation direction; and a detector which detects the amount of toner 9 stored in the toner stirring chamber 33 according to a result of measuring a time period during which light emitted from the light-emitting unit 64 and passing through the light-passing section 60*c* is being received at the light-receiving unit 65. The detector includes the light-emitting unit 64; the light-receiving unit 65; and the developer detection unit 43*a* which detects the amount of toner 9 stored in the toner stirring chamber 33 according to a result of measuring a time period during which light emitted from the light-emitting unit 64 and passing through the light-passing section 60*c* is being received at the light-receiving unit 65, for example.

<Operation of Developer Detection Device>

FIGS. 18A to 18E are explanatory diagrams illustrating rotating operation of the stirring gear 62 and the stirring bar 61 which are main components of the developer detection device according to the first embodiment.

Figure 18A:
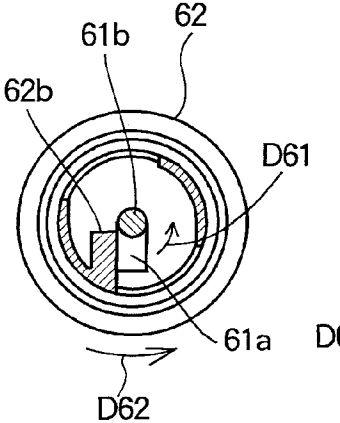
FIGS. 18A to 18E are explanatory diagrams schematically illustrating a series of rotating operation of the stirring gear and the stirring bar which are main components of the developer detection device according to the first embodiment.
Figure 18B:
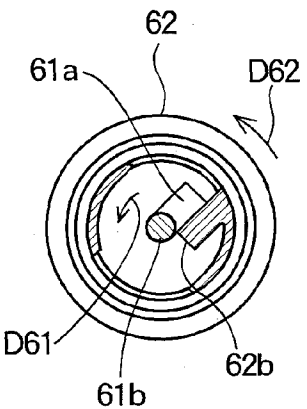

The stirring bar 61 illustrated in FIG. 18A is in a rotation position which allows the rotation driven part 61*a* to be below the first rotation shaft part 61*b*. The stirring gear 62 receives a driving force from the drive unit 41 (FIG. 1) and rotates in a D62 direction at a fixed speed. As a result of the rotation of the stirring gear 62, the rotation driving rib 62*b* of the stirring gear 62 abuts the rotation driven part 61*a* of the stirring bar 61 and presses the rotation driven part 61*a* in a D61 direction, and thus the stirring bar 61 rotates as illustrated in FIG. 18B.

Figure 18C:
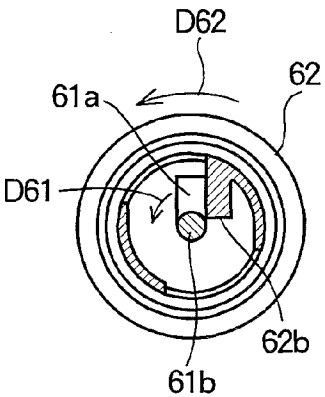

Then, as illustrated in FIG. 18C, the stirring bar 61 moves to a rotation position which allows the rotation driven part 61*a* to be above the first rotation shaft part 61*b*. At the time, the stirring part 61*d* of the stirring bar 61 is also above the first rotating shaft section 61*b*. After an end of the rotation driven part 61*a* of the stirring bar 61 points upward, i.e., after the stirring part 61*d* of the stirring bar 61 reaches a top point which is a predetermined rotation position, as illustrated in FIG. 18C, the stirring bar 61 rotates by its own weight (independently of the pressing force from the rotation driving rib 62*b* of the stirring gear 62). Then, when the stirring part 61*d* of the stirring bar 61 comes into contact with the upper surface 9*a* of the toner 9, the stirring bar 61 stops rotating by its own weight in a rotation position (i.e., at a rotation angle) corresponding to a toner upper surface position of the upper surface 9*a* of the toner 9 stored in the toner stirring chamber 33, as illustrated in FIG. 18D.

Figure 18D:
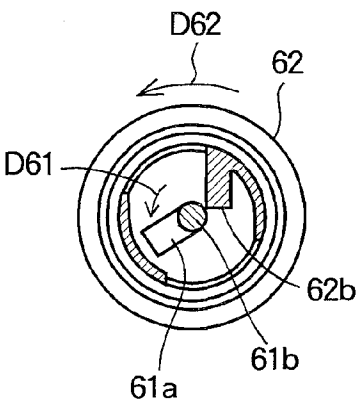
Figure 18E:
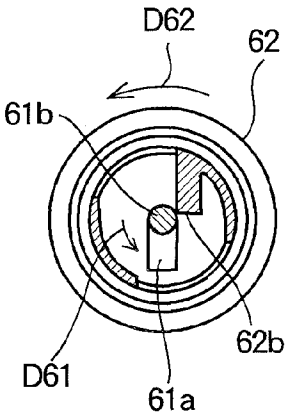

In a case illustrated in FIG. 18E where there is less toner in the toner stirring chamber 33 than in the case in FIG. 18D, after the end of the rotation driven part 61*a* of the stirring bar 61 points upward, i.e., after the stirring part 61*d* of the stirring bar 61 reaches the top position which is the predetermined rotation position as illustrated in FIG. 18C, the stirring bar 61 rotates by its own weight (individually of the pressing force from the rotation driving rib 62*b* of the stirring gear 62). Then, when the stirring part 61*d* of the stirring bar 61 comes into contact with the upper surface 9*a* of the toner 9, the stirring bar 61 stops rotating by its own weight in a rotation position (i.e., at a rotation angle) corresponding to a toner upper surface position of the upper surface 9*a* of the toner 9 stored in the toner stirring chamber 33, as illustrated in FIG. 18E.

A position where the stirring bar 61 stops rotating corresponds to a toner upper surface position which is a position of the upper surface 9*a* of the toner 9, i.e., the remaining amount of toner 9. A position of the light-passing section 61*c* of the detection plate 61 also corresponds to a position where the stirring bar 61 stops rotating. Accordingly, a position of the light-passing section 61*c* of the detection plate 61 corresponds to the remaining amount of toner 9 stored in the toner stirring chamber 33. Thus, the remaining amount of toner 9 (e.g., the remaining amount of toner is small) can be detected by detecting a position of the light-passing section 61*c* of the detection plate 61.

FIGS. 19A to 19E are explanatory diagrams illustrating changes in the rotating operation of the stirring bar 61 which is a main component of the developer detection device according to the first embodiment, depending on toner upper surface positions of the upper surface 9*a* of the toner 9 stored in the toner stirring chamber 33 (corresponding to the remaining amount of toner of the toner 9).

Figures 19A, 19B, 19C, 19D, 19E:
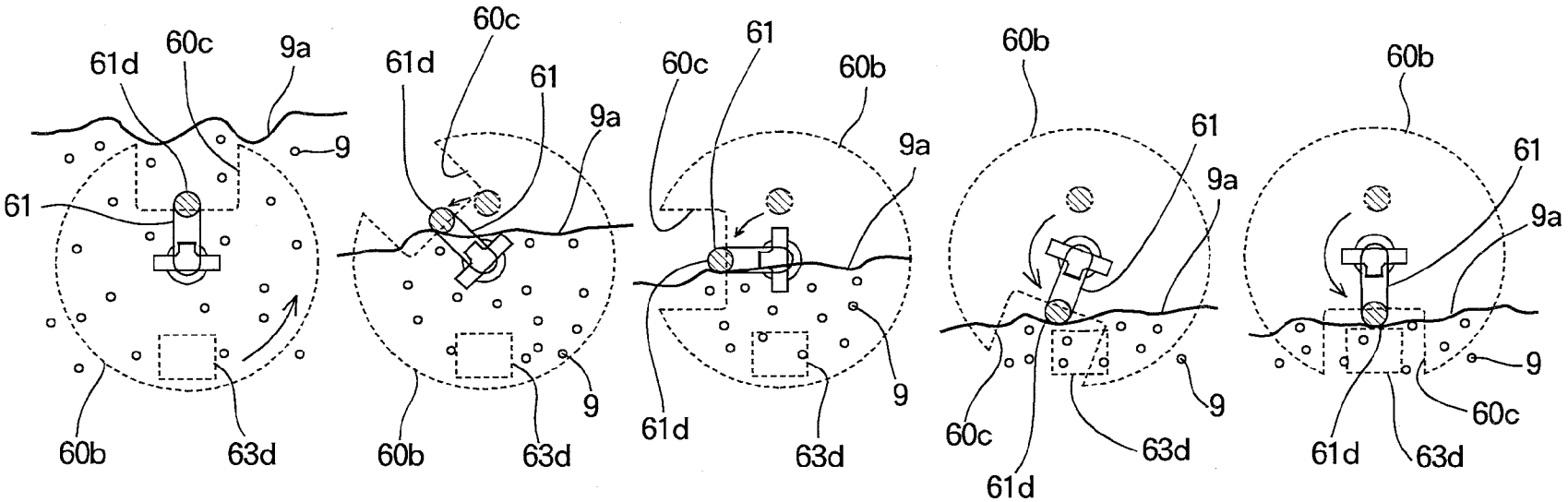
FIGS. 19A to 19E are explanatory diagrams schematically illustrating various kinds of rotating operation of the stirring bar as a main component of the developer detection device according to the first embodiment, which vary depending on the remaining amount of toner stored in a toner stirring chamber.

As illustrated in FIG. 19A, when the toner upper surface position of the upper surface 9*a* of the toner 9 stored in the toner stirring chamber 33 is higher than the top position of the stirring part 61*d* of the stirring bar 61, which is the highest position of the stirring part 61*d* illustrated in FIG. 19A, the stirring bar 61 does not rotate by its own weight, but rotates from its top position according to rotation of the rotation driving rib 62*b* of the stirring gear 62.

In a case illustrated in FIG. 19B where the amount of toner 9 stored in the toner stirring chamber 33 is further reduced, when the upper surface 9*a* of the toner 9 is lower than the top position of the stirring part 61*d* of the stirring bar 61 as a result of the reduction in the amount of toner 9 stored in the toner stirring chamber 33, the stirring bar 61 rotates by the weight of the stirring part 61*d* immediately after the stirring part 61*d* of the stirring bar 61 reaches the highest point of a rotation track. Then, the stirring part 61*d* is supported by the toner 9 in a position of the upper surface 9*a* of the toner 9 (strictly speaking, on somewhat below the position of the upper surface 9*a*) and the stirring bar 61 stops rotating. In the case in FIG. 19B, even when the rotation of the stirring bar 61 by its own weight stops, the light-blocking section 60*b* of the detection plate 60 covers the light exit section 63*d* of the detection light guide 63, in other words, there is the light-blocking section 60*b* of the detection plate 60 between the light exit section 63*d* of the detection light guide 63 and the light-receiving unit 65. Thus, a time period, during which the light emitted from the light exit section 63*d* of the detection light guide 63 is passing through the light-passing section 60*c* of the detection plate 60 and is incident on the light-receiving unit 65, is equal to a time period, during which the light exit section 63*d* of the detection light guide 63 is passing through a front of the light-passing section 60*c* of the detection plate 60 in a process of rotation of the detection plate 60 in accordance with rotation of the rotation driving rib 62*b* of the stirring gear 62.

In a case illustrated in FIG. 19C where the amount of toner 9 stored in the toner stirring chamber 33 further decreases, after the stirring part 61*d* of the stirring bar 61 reaches the highest point of the rotation track, a rotation angle of the rotation of the stirring part 61*d* by the weight of the stirring bar 61 increases. The stirring part 61*d* is supported by the toner 9 in a position somewhat below the upper surface 9*a* of the toner 9, and then the rotation of the stirring bar 61 stops. In the case in FIG. 19C, even when the rotation of the stirring bar 61 by its own weight stops, the light-blocking section 60*b* of the detection plate 60 covers the light exit section 63*d* of the detection light guide 63, in other words, there is the light-blocking section 60*b* of the detection plate 60 between the light exit section 63*d* of the detection light guide 63 and the light-receiving unit 65. Thus, a time period during which the light emitted from the light exit section 63*d* of the detection light guide 63 is passing through the light-passing section 60*c* of the detection plate 60 and is incident on the light-receiving unit 65 is equal to a time period during which the light exit section 63*d* of the detection light guide 63 is passing through the front of the light-passing section 60*c* of the detection plate 60 in a process of rotation of the detection plate 60 in accordance with rotation of the rotation driving rib 62*b* of the stirring gear 62.

In a case illustrated in FIG. 19D where the amount of toner 9 stored in the toner stirring chamber 33 further decreases, after the stirring part 61*d* of the stirring bar 61 reaches the highest point of the rotation track, the rotation angle of the rotation of the stirring bar 61 by the weight of the stirring part 61*d* further increases. When the rotation of the stirring bar 61 by its own weight stops, part of the light-passing section 60*c* of the detection plate 60 faces the light exit section 63*d* of the detection light guide 63. In this case, immediately after the rotation of the stirring bar 61 by its own weight stops, light from the light exit section 63*d* of the detection light guide 63 passes through the light-passing section 60*c* of the detection plate 60 and enters the light-receiving unit 65. Thus, during the rotation driving rib 62*b* of the stirring gear 62 does not press the rotation driven part 61*a* of the stirring bar 61, the light from the light exit section 63*d* of the detection light guide 63 passes through the light-passing section 60*c* of the detection plate 60 and enters the light-receiving unit 65. Thus, a time period during which the light from the light exit section 63*d* of the detection light guide 63 is passing through the light-passing section 60*c* of the detection plate 60 and is incident on the light-receiving unit 65 is longer than the time period during which the light from the light exit section 63*d* of the detection light guide 63 is passing through the light-passing section 60*c* of the detection plate 60 and is incident on the light-receiving unit 65 in each of the cases in FIGS. 19A to 19C.

In a case illustrated in FIG. 19E where the amount of toner 9 stored in the toner stirring chamber 33 further decreases, after the stirring part 61*d* of the stirring bar 61 reaches the highest point of the rotation track, a rotation angle of the rotation of the stirring bar 61 by the weight of the stirring part 61*d* further increases. When the rotation of the stirring bar 61 by its own weight stops, part of the light-passing section 60*c* of the detection plate 60 faces the light exit section 63*d* of the detection light guide 63. In this case, immediately after the rotation of the stirring bar 61 by its own weight stops, the light from the light exit section 63*d* of the detection light guide 63 passes through the light-passing section 60*c* of the detection plate 60 and enters the light-receiving unit 65. Thus, during the rotation driving rib 62*b* of the stirring gear 62 does not press the rotation driven part 61*a* of the stirring bar 61, the light from the light exit section 63*d* of the detection light guide 63 passes through the light-passing section 60*c* of the detection plate 60 and enters the light-receiving unit 65. Thus, a time period during which the light from the light exit section 63*d* of the detection light guide 63 is passing through the light-passing section 60*c* of the detection plate 60 and is incident on the light-receiving unit 65 is further longer than the time period during which the light from the light exit section 63*d* of the detection light guide 63 is passing through the light-passing section 60*c* of the detection plate 60 and is incident on the light-receiving unit 65 in each of the cases in FIGS. 19A to 19C.

Figure 20:
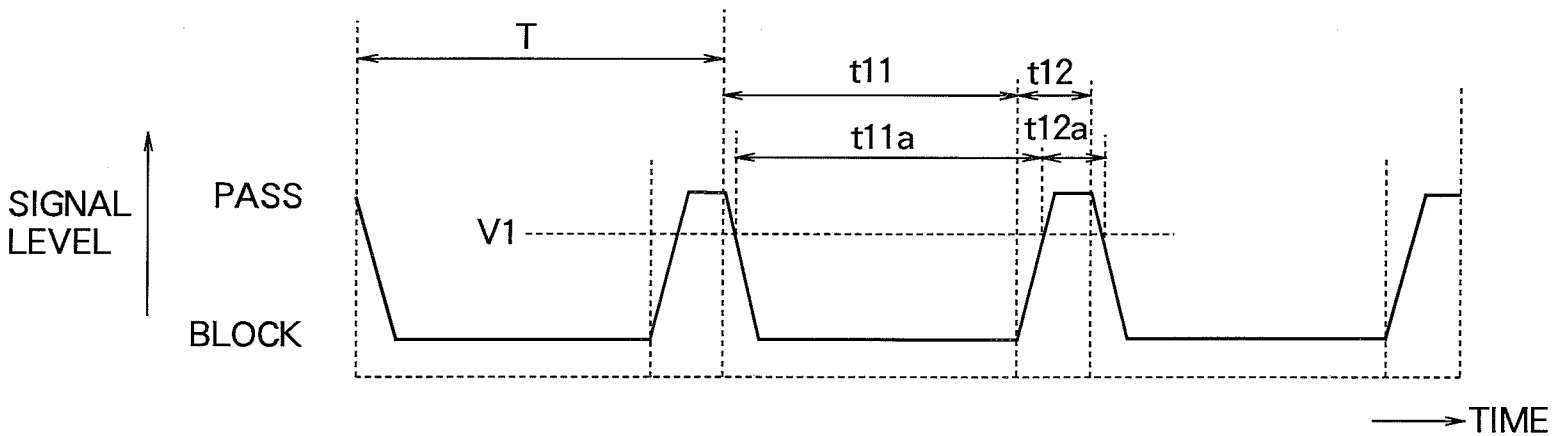
FIG. 20 is a timing chart showing light detection timings by a light-receiving unit, in a case where the amount of toner stored in the toner stirring chamber is large in the developing unit which has the developer detection device according to the first embodiment as illustrated in FIG. 19A.

FIG. 20 is a timing chart showing timings of detecting the light emitted from the light exit section 63*d* of the detection light guide 63 and passing through the light-passing section 60*c* of the detection plate 60 by the light-receiving unit 65, when the amount of toner 9 stored in the toner stirring chamber 33 is large (e.g., in the case in FIG. 19A). In FIG. 20, "T" represents a rotation period of the stirring bar 61; "t11" represents a time period during which the light-receiving unit 65 is not detecting the light from the light-emitting unit 64 (i.e., a light blocked period); and "t12" represents a time period during which the light-receiving unit 65 is detecting the light from the light-emitting unit 64 (i.e., a light passing period). As illustrated in FIG. 20, in the case where the amount of toner 9 stored in the toner stirring chamber 33 is large, the light passing period t12 is short and the blocked period t11 is long. In FIG. 20, "t12*a*" and "t11*a*"represent a light passing period and a light blocked period, respectively, when a value V1 is set as a threshold value for judging the light passing period.

Figure 21:
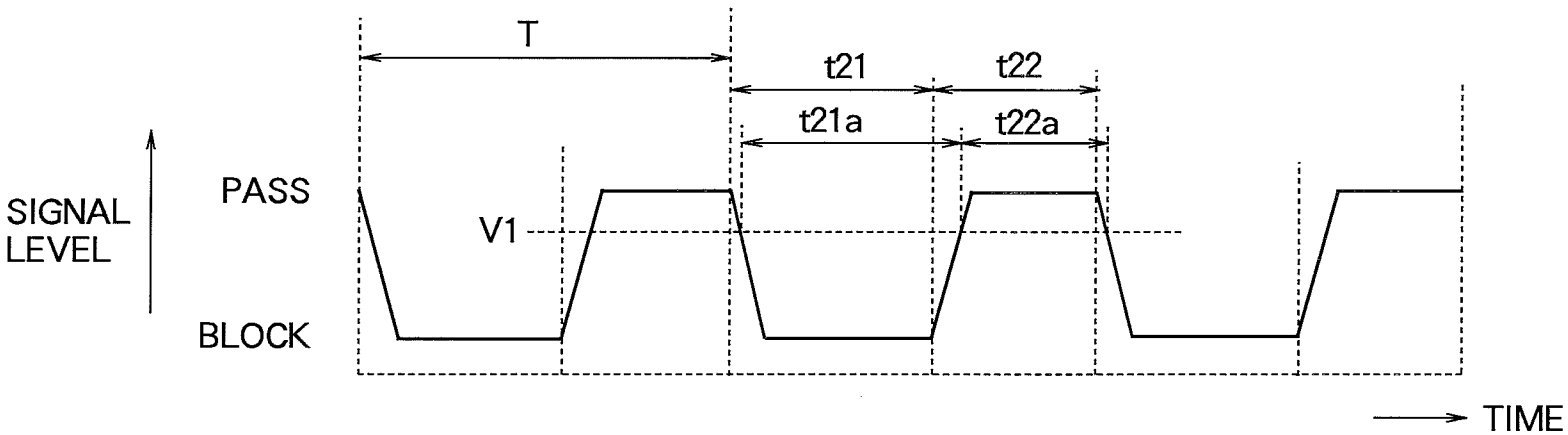
FIG. 21 is a timing chart showing light detection timings by the light-receiving unit, in a case where the amount of toner stored in the toner stirring chamber is small in the developing unit which has the developer detection device according to the first embodiment as illustrated in FIG. 19E.

FIG. 21 is a timing chart showing timings of detecting the light emitted from the light exit section 63*d* of the detection light guide 63 and passing through the light-passing section 60*c* of the detection plate 60 by the light-receiving unit 65, when the amount of toner 9 stored in the toner stirring chamber 33 is small (e.g., in the case in FIG. 19E). In FIG. 21, "t21" represents a time period during which the light-receiving unit 65 is not detecting the light from the light-emitting unit 64 (i.e., a light blocked period); and "t22" represents a time period during which the light-receiving unit 65 is detecting the light from the light-emitting unit 64 (i.e., a light passing period). As illustrated in FIG. 21, in the case where the amount of toner 9 stored in the toner stirring chamber 33 is large, the light passing period t22 is short and the light blocked period t21 is long. In FIG. 21, "t22*a*" and "t21*a*" represent a light passing period and a light blocked period, respectively, when a value V1 is set as a threshold value for judging the light passing period.

As illustrated in FIG. 20 and FIG. 21, when the amount of toner 9 stored in the toner stirring chamber 33 is large, the light passing period is short, and when the amount of toner 9 stored in the toner stirring chamber 33 is small, the light passing period is long. Thus, the control unit 43 measures the light passing period during which the light is being detected by the light-receiving unit 65, and if the light passing period is not less than a predetermined time period (threshold), the control unit 43 can judge that the amount of toner 9 is small.

<Effects of First Embodiment>

As described above, the developer detection device according to the first embodiment detects that the amount of toner stored in the toner stirring chamber 33 decreases, on the basis of a light passing period during which the light-receiving unit 65 is detecting light. The detection of the reduction in the amount of toner stored in the toner stirring chamber 33 based on the light passing period during which the light-receiving unit 65 is detecting light makes it possible to detect the amount of toner stored in the toner stirring chamber 33 more correctly, in comparison with the conventional art where the reduction in the amount of toner stored in the toner stirring chamber 33 is detected on the basis of a light blocked period during which the light is being blocked. This is because the following reason: it is difficult to block light completely because of the structure, some light components reach the light-receiving unit 65 due to diffraction, leakage light (including reflection light, diffusion light or the like, even in the light blocked period during which light is being blocked from entering the light-receiving unit 65) or the like, and as a result, a reduction in the remaining amount of toner cannot be detected, even if the actual remaining amount of toner decreases. In other words, in a case where it is detected that the remaining amount of toner is small by using a light blocked period as in the conventional art, the remaining amount of toner cannot be correctly detected, because light diffraction, leakage light and the like cause a slight light component to be incident on the light-receiving unit. Moreover, in the case where it is detected that the remaining amount of toner is small by using a light blocked period as in the conventional art, if a high threshold value is set, i.e., if it is set to judge as a light blocked period even if a small extent of light enters, in order to protect from an influence of a slight light component incident on the light-receiving unit due to light diffraction, leakage light and the like, and if somewhere, e.g., the detection light guide, is with grime in an optical path from the light-emitting unit to the light-receiving unit, a time period which is not a light blocked period actually is erroneously judged to be a light blocked period, and such an erroneous judgment is easily made.

FIGS. 22A to 22F are diagrams illustrating positional relationships between rotation angles of the detection plate 60 (positions of the light-passing section 60*c* of the detection plate 60) and the light exit section 63*d* of the detection light guide 63 in the developer detection device according to the first embodiment.

Figures 22A, 22B, 22C, 22D, 22E, 22F:
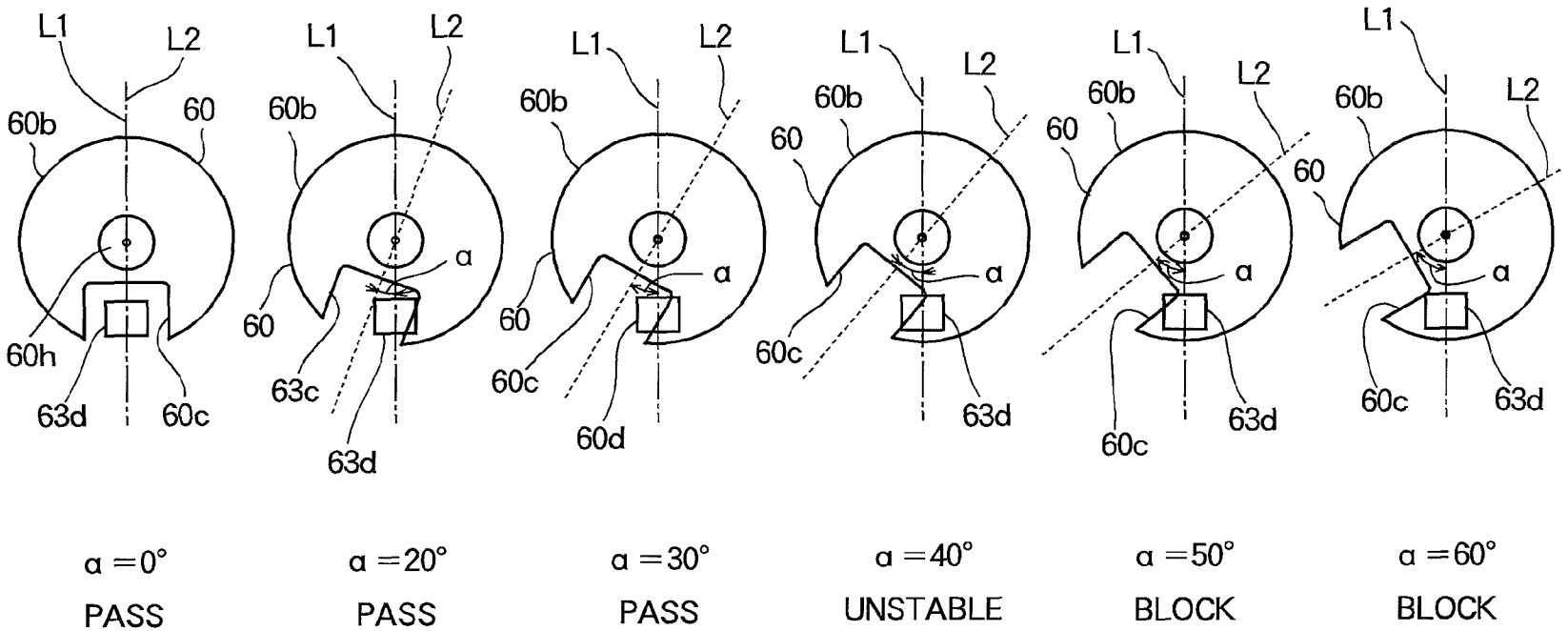
FIGS. 22A to 22F are diagrams illustrating positional relationships between rotation angles of the detection plate and a light exit section which are main components of the developer detection device according to the first embodiment.

In the drawings, a first center line L1 passes through a center (an axial line position) 60*h* of the detection plate 60 and divides the light exit section 63*d* of the detection light guide 63 in two parts, and a second center line L2 passes through the center 60*h* of the detection plate 60 and divides the light-passing section 60*c* of the detection plate 60 in two parts. As illustrated in FIG. 22A, when the first center line L1 agrees with the second center line L2 and an angle α made by the first center line L1 and the second center line L2 is 0', light emitted from the light exit section 63*d* of the detection light guide 63 passes through the light-passing section 60*c* of the detection plate 60 and then reaches the light-receiving unit 65. Thus, the light-receiving unit 65 can reliably detect the light emitted from the light exit section 63*d* of the detection light guide 63 and passing through the light-passing section 60*c* of the detection plate 60.

As illustrated in FIG. 22B, when the angle α made by the first center line L1 and the second center line L2 is 20°, most of the light emitted from the light exit section 63*d* of the detection light guide 63 passes through the light-passing section 60*c* of the detection plate 60 and then reaches the light-receiving unit 65. Thus, the light-receiving unit 65 can reliably detect the light emitted from the light exit section 63*d* of the detection light guide 63 and passing through the light-passing section 60*c* of the detection plate 60.

As illustrated in FIG. 22C, when the angle α made by the first center line L1 and the second center line L2 is 30°, half of the light emitted from the light exit section 63*d* of the detection light guide 63 passes through the light-passing section 60*c* of the detection plate 60 and then reaches the light-receiving unit 65. Thus, the light-receiving unit 65 can reliably detect the light emitted from the light exit section 63*d* of the detection light guide 63 and passing through the light-passing section 60*c* of the detection plate 60.

As illustrated FIG. 22D, when the angle α made by the first center line L1 and the second center line L2 is 40°, much of the light emitted from the light exit section 63*d* of the detection light guide 63 (e.g., about ⅔ or more) cannot pass through the light-passing section 60*c* of the detection plate 60. Thus, the light-receiving unit 65 cannot detect a sufficient amount of the light emitted from the light exit section 63*d* of the detection light guide 63. In other words, a judgment result differs each time the developer detection unit 43*a* of the control unit 43 judges whether it is a time period during which the light from the light exit section 63*d* of the detection light guide 63 is being detected by the light-receiving unit 65 or a time period during which the light from the light exit section 63*d* of the detection light guide 63 is not being detected by the light-receiving unit 65, i.e., the judgments results are unstable.

As illustrated in FIG. 22E, when the angle α made by the first center line L1 and the second center line L2 is 50°, most of the light emitted from the light exit section 63*d* of the detection light guide 63 cannot pass through the light-passing section 60*c* of the detection plate 60. Thus, the light-receiving unit 65 can hardly detect the light emitted from the light exit section 63*d* of the detection light guide 63 and passing through the light-passing section 60*c* of the detection plate 60.

As illustrated in FIG. 22F, when the angle α made by the first center line L1 and the second center line L2 is 60°, substantially whole of the light emitted from the light exit section 63*d* of the detection light guide 63 cannot pass through the light-passing section 60*c* of the detection plate 60. Thus, the light-receiving unit 65 cannot detect the light emitted from the light exit section 63*d* of the detection light guide 63 and passing through the light-passing section 60*c* of the detection plate 60.

As illustrated in FIGS. 22A to 22F, when the developer detection unit 43*a* of the control unit 43 judges that the amount of toner stored in the toner stirring chamber 33 decreases on the basis of a light passing period during which the light emitted from the light exit section 63*d* of the detection light guide 63 and passing through the light-passing section 60*c* of the detection plate 60 is being detected by the light-receiving unit 65, if the angle α made by the first center line L1 and the second center line L2 is large (e.g., if α=30°), the developer detection device according to the first embodiment can correctly detect the amount of toner stored in the toner stirring chamber 33. This is because the following reason: when the detection is based on a light passing period, i.e., a time period during which light is being received by the light-receiving unit 65, even if there is a light component incident on the light-receiving unit 65 due to light diffraction or leakage light, the proportion of the light component in the whole amount of incident light on the light-receiving unit 65 is extremely small, and so the light component incident on the light-receiving unit 65 due to light diffraction or leakage light scarcely influences a judgment on the amount of toner stored in the toner stirring chamber 33. Another reason is as follows: when it is detected that the remaining amount of toner is small on the basis of a light passing period, since a light amount of incident light on the light-receiving unit 65 from the light exit section 63*d* is much larger than a light amount of incident light on the light-receiving unit due to light diffraction or leakage light during the light passing period, a signal-level threshold value is easily set for distinguishing between the incident light on the light-receiving unit 65 from the light exit section 63*d* and the incident light on the light-receiving unit due to light diffraction or leakage light.

FIGS. 23A to 23F are diagrams illustrating positional relationships between rotation angles of a light blocking plate 460 and the light exit section 63*d* of the detection light guide 63, in a comparison example (conventional art) where the light blocking plate 460 is included instead of the detection plate 60.

Figures 23A, 23B, 23C, 23D, 23E, 23F:
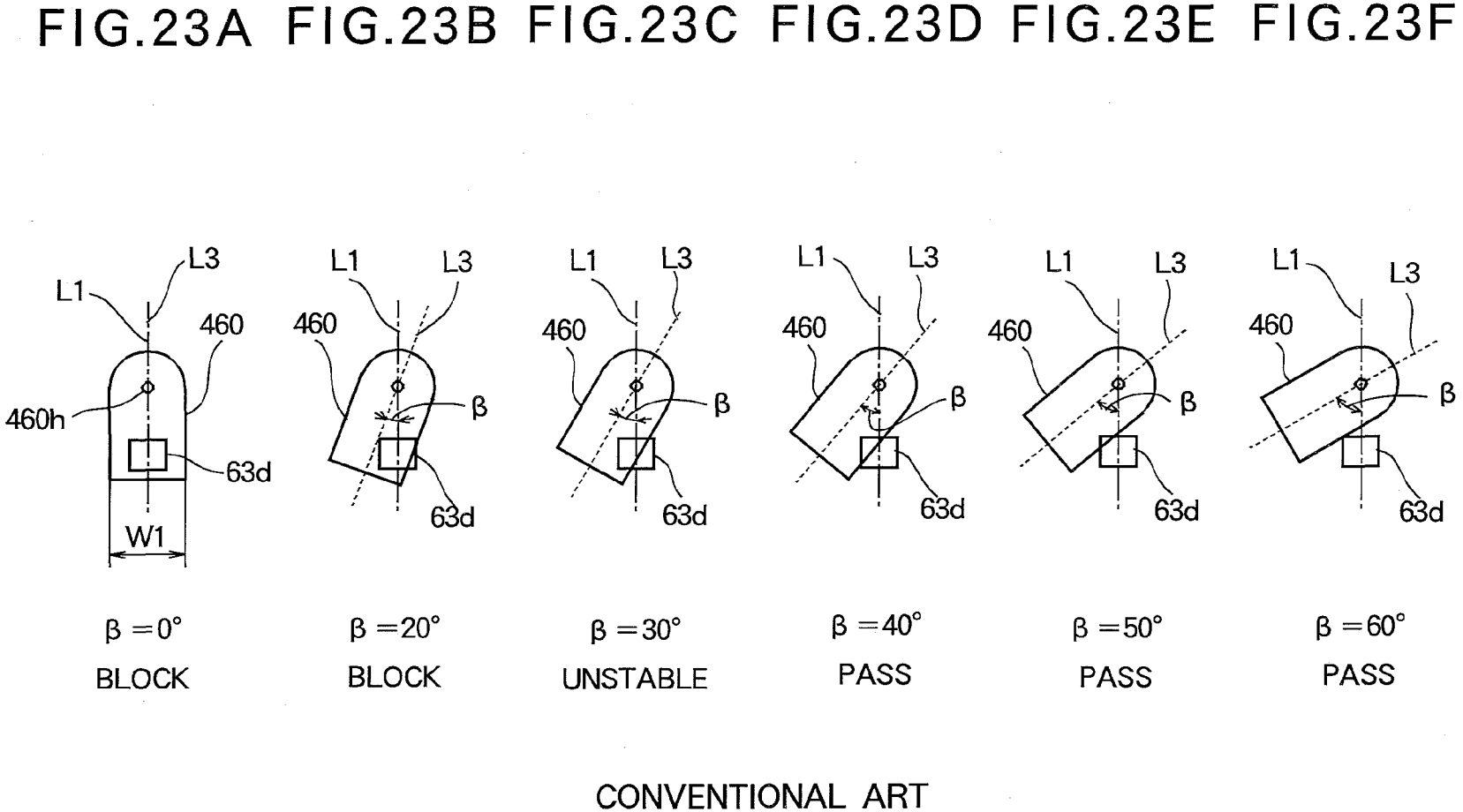
FIGS. 23A to 23F are diagrams illustrating positional relationships between a light blocking plate and a light exit section in a comparison example.

In the drawings, a first center line L1 passes through a center (an axial line position) 460*h* of the light blocking plate 460 and divides the light exit section 63*d* of the detection light guide 63 in two parts; and a third center line L3 passes through the center 460*h* of the light blocking plate 460 and divides the light blocking plate 460 in two parts. As illustrated in FIG. 23A, when the first center line L1 agrees with the third center line L3 and an angle β made by the first center line L1 and the third center line L3 is 0°, light emitted from the light exit section 63*d* of the detection light guide 63 is blocked by the light blocking plate 460 and does not reach the light-receiving unit 65, and thus the light-receiving unit 65 detects no light.

As illustrated in FIG. 23B, when the angle β made by the first center line L1 and the third center line L3 is 20°, most of the light emitted from the light exit section 63*d* of the detection light guide 63 is blocked by the light blocking plate 460. Thus, the light-receiving unit 65 hardly detects the light from the light exit section 63*d* of the detection light guide 63.

As illustrated in FIG. 23C, when the angle β made by the first center line L1 and the third center line L3 is 30°, part of the light emitted from the light exit section 63*d* of the detection light guide 63 (e.g., about ⅓ or more) is not blocked by the light blocking plate 460 and enters the light-receiving unit 65, so the light-receiving unit 65 detects some degree of the light from the light exit section 63*d* of the detection light guide 63. Thus, the developer detection unit 43*a* of the control unit 43 unstably judges whether it is a time period during which the light from the light exit section 63*d* of the detection light guide 63 is being detected by the light-receiving unit 65 or a time period during which the light from the light exit section 63*d* of the detection light guide 63 is not being detected by the light-receiving unit 65.

As illustrated in FIG. 23D, when the angle β made by the first center line L1 and the third center line L3 is 40°, half or more than half of the light emitted from the light exit section 63*d* of the detection light guide 63 is not blocked by the light blocking plate 460 and enters the light-receiving unit 65. Thus, the light-receiving unit 65 reliably detects the light from the light exit section 63*d* the detection light guide 63.

As illustrated in FIG. 23E, when the angle β made by the first center line L1 and the third center line L3 is 50°, most of the light emitted from the light exit section 63*d* of the detection light guide 63 is not blocked by the light blocking plate 460 and enters the light-receiving unit 65. Thus, the light-receiving unit 65 reliably detects the light from the light exit section 63*d* of the detection light guide 63.

As illustrated in FIG. 23F, when the angle β made by the first center line L1 and the third center line L3 is 60°, substantially whole of the light emitted from the light exit section 63*d* of the detection light guide 63 is not blocked by the light blocking plate 460 and enters the light-receiving unit 65. Thus, the light-receiving unit 65 reliably detects the light from the light exit section 63*d* of the detection light guide 63.

As in the comparison example illustrated in FIGS. 23A to 23F, when the developer detection unit of the control unit judges that the amount of toner stored in the toner stirring chamber 33 decreases, on the basis of a light blocked period during which the light emitted from the light exit section 63*d* of the detection light guide 63 is being blocked by the light blocking plate 460, if the angle β made by the first center line L1 and the third center line L3 is small (e.g., β=20°), the amount of toner stored in the toner stirring chamber 33 can be correctly detected; if the angle β is 30°, a comparatively small angle, the amount of toner stored in the toner stirring chamber 33 cannot be correctly detected and a judgment result differs each time it is judged whether the remaining amount of toner is small or not, i.e., the judgment results are unstable. This is because the following reason: when the detection is based on a light blocked period, i.e., a time period during which the light-receiving unit 65 is not detecting light whose signal level is greater than a predetermined signal level, if there is a light component incident on the light-receiving unit 65 due to light diffraction or leakage light, the proportion of the light component in the whole amount of incident light on the light-receiving unit 65 is extremely large during the light blocked period, and so the light component incident on the light-receiving unit 65 due to light diffraction or leakage light easily influences a judgment on the amount of toner stored in the toner stirring chamber 33.

As can be understood from a comparison between FIGS. 22A to 22F illustrating the first embodiment and FIGS. 23A to 23F illustrating the comparison example, when the amount of toner stored in the toner stirring chamber 33 is detected on the basis of a light passing period during which the light-receiving unit 65 is detecting light, if the angle α made by the first center line L1 and the second center line L2 is comparatively large (e.g., up to 30° or so), a correct detection can be made. When the amount of toner stored in the toner stirring chamber 33 is detected on the basis of a light blocked period during which the light-receiving unit 65 is detecting no light as in the comparison example, a stable detection can be made only when the angle β made by the first center line L1 and the third center line L3 is comparatively small (e.g., up to 20°). Thus, when the detection is made based on a light blocked period as in the comparison example, if the stirring bar 61 which rotates and falls due to its own weight stops in different positions, the amount of toner stored in the toner stirring chamber 33 cannot be correctly detected and erroneous detections frequently occur.

Figure 24:
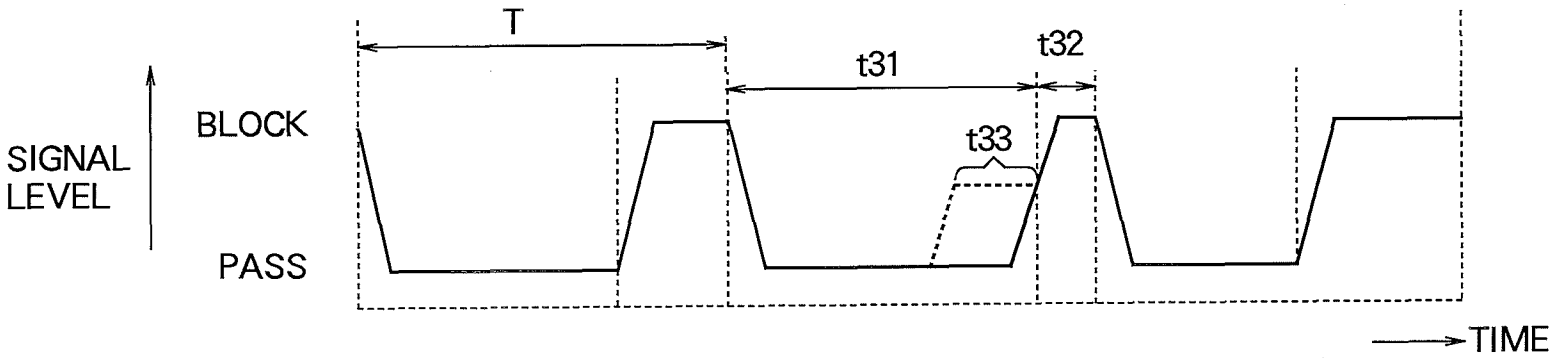
FIG. 24 is a timing chart showing light detection timings by a light-receiving unit in the comparison example illustrated in FIGS. 23A to 23F.

FIG. 24 is a timing chart showing light detection timing by the light-receiving unit 65 in the comparison example in FIGS. 23A to 23F. In the drawing, "T" represents a rotation period of the stirring bar 61; "t31" represents a light blocked period; and "t32" represents a light passing period. As illustrated in FIG. 24, when the amount of toner stored in the toner stirring chamber 33 is judged on the basis of a light blocked period as in the comparison example, it is unstably judged whether it is a light blocked period or a light passing period, if there is leakage light which is detected in a time t33 due to some causes.

FIGS. 25A to 25F are diagrams illustrating positional relationships between rotation angles of a light blocking plate 560 and the light exit section 63*d* of the detection light guide 63 in another comparison example where a width W2 of the light blocking plate 560 is greater than a width W1 of the light blocking plate 460 illustrated in FIGS. 23A to 23F.

Figures 25A, 25B, 25C, 25D, 25E, 25F:
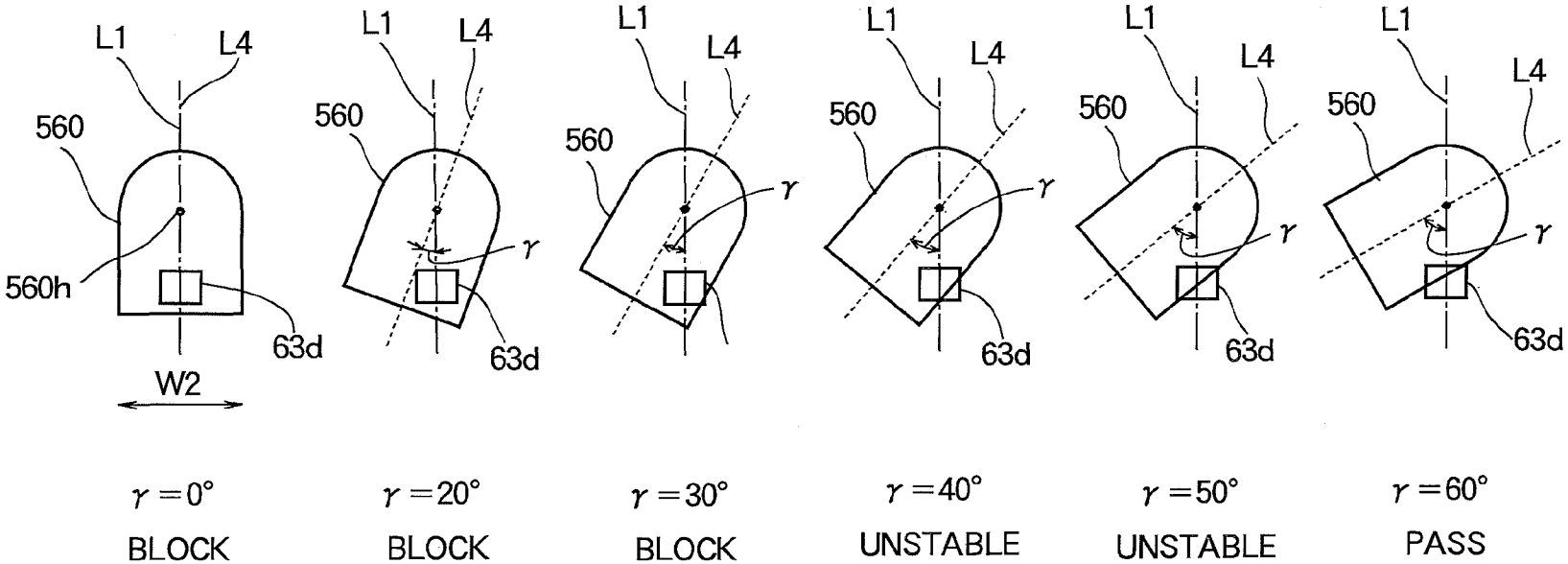
FIG.25A FIG.25B FIG.25C FIG.25D FIG.25E FIG.25F CONVENTIONAL ART
FIGS. 25A to 25F are diagrams illustrating positional relationships between a light blocking plate and a light exit section in another comparison example where a width of the light blocking plate is larger.

In the drawings, a first center line L1 passes through a center (an axial line position) 560*h* of the light blocking plate 560 and divides the light exit section 63*d* of the detection light guide 63 in two parts; and a fourth center line L4 passes through the center 560*h* of the light blocking plate 560 and divides the light blocking plate 560 in two parts. As illustrated in FIG. 25A, when the first center line L1 which agrees with the fourth center line L4 and an angle γ made by the first center line L1 and the fourth center line L4 is 0°, light emitted from the light exit section 63*d* of the detection light guide 63 is blocked by the light blocking plate 560 and does not reach the light-receiving unit 65, and thus the light-receiving unit 65 detects no light.

As illustrated in FIG. 25B, when the angle γ made by the first center line L1 and the fourth center line L4 is 20°, the light emitted from the light exit section 63*d* of the detection light guide 63 is also blocked by the light blocking plate 560. Thus, the light-receiving unit 65 does not detect the light from the light exit section 63*d* of the detection light guide 63.

As illustrated in FIG. 25C, when the angle γ made by the first center line L1 and the fourth center line L4 is 30°, the light emitted from the light exit section 63*d* of the detection light guide 63 is substantially blocked by the light blocking plate 560. Thus, the light-receiving unit 65 hardly detects the light from the light exit section 63*d* of the detection light guide 63.

As illustrated in FIG. 25D, when the angle γ made by the first center line L1 and the fourth center line L4 is 40°, part of the light emitted from the light exit section 63*d* of the detection light guide 63 (e.g., about ⅓ or less) which is not blocked by the light blocking plate 560 enters the light-receiving unit 65, and the light-receiving unit 65 detects some degree of the light from the light exit section 63*d* of the detection light guide 63. Thus, the developer detection unit 43*a* of the control unit 43 unstably judges whether it is a time period during which the light from the light exit section 63*d* of the detection light guide 63 is being detected by the light-receiving unit 65 or a time period during which the light from the light exit section 63*d* of the detection light guide 63 is not being detected by the light-receiving unit 65.

As illustrated in FIG. 25E, when the angle γ made by the first center line L1 and the fourth center line L4 is 50°, part of the light emitted from the light exit section 63*d* of the detection light guide 63 (e.g., about ⅓) which is not blocked by the light blocking plate 560 enters the light-receiving unit 65, and the light-receiving unit 65 detects some degree of the light from the light exit section 63*d* of the detection light guide 63. Thus, the developer detection unit 43*a* of the control unit 43 unstably judges whether it is a time period during which the light from the light exit section 63*d* of the detection light guide 63 is being detected by the light-receiving unit 65 or a time period during which the light from the light exit section 63*d* of the detection light guide 63 is not being detected by the light-receiving unit 65.

As illustrated in FIG. 25F, when the angle γ made by the first center line L1 and the fourth center line L4 is 60°, the light-receiving unit 65 can reliably detect the light emitted from the light exit section 63*d* of the detection light guide 63.

As described above, if the width W2 of the light blocking plate 560 is increased, the amount of toner stored in the toner stirring chamber 33 cannot be correctly judged, since an angle (a time) that the light emitted from the light exit section 63*d* of the detection light guide 63 is unstably detected increases.

Figure 26:
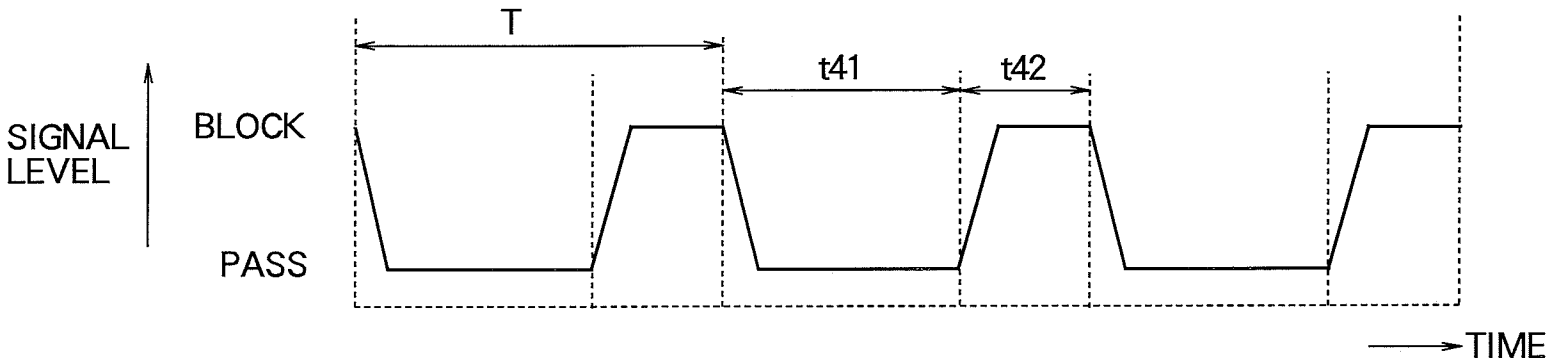
FIG. 26 is a timing chart showing light detection timings by a light-receiving unit in another comparison example illustrated in FIGS. 25A to 25F.

FIG. 26 is a timing chart showing light detection timings by the light-receiving unit 65, when the amount of toner 9 stored in the toner stirring chamber 33 is large in the case illustrated in FIGS. 25A to 25F. In FIG. 26, in comparison with the case illustrated in FIGS. 25A to 25F, the light blocked period t42 is long and the light passing period t41 is short in both cases when the amount of toner stored in the toner stirring chamber 33 is large and when the amount of toner stored is small. For this reason, it is difficult to set a time threshold value for judging that the amount of toner stored in the toner stirring chamber 33 decreases.

As described above, according to the developer detection device according to the first embodiment, since the light from the light exit section 63*d* of the detection light guide 63 can be correctly detected by the light-receiving unit 65, the amount of toner stored in the toner stirring chamber 33 can be correctly detected. In the first embodiment especially, a reduction in the amount of toner stored in the toner stirring chamber 33 can be correctly detected, even if the light passing through the light-passing section 60*c* of the detection plate 60 includes a leakage light component. Therefore, a reduction in the amount of toner stored in the toner stirring chamber 33 can be correctly detected, even if the light-passing section 60*c* of the detection plate 60 stops in various positions.

In the image forming apparatus 1 according to the first embodiment, since the light-emitting unit 64 and the light-receiving unit 65 are not disposed on a side closer to the developing unit 3 as illustrated in FIG. 17, an inefficient replacement of the light-emitting unit 64 and the light-receiving unit 65 can be avoided when the developing unit 3 is replaced.

Moreover, in the image forming apparatus 1, since the light-emitting unit 64 and the light-receiving unit 65 are not disposed on the side closer to the developing unit 3, it is not necessary that the developing unit 3 should have a wiring for supplying power to the light-emitting unit 64 and the light-receiving unit 65, and therefore a flexibility in an arrangement the light-emitting unit 64 and the light-receiving unit 65 is improved and the developing unit 3 is easily manufactured.

In the first embodiment, the bending direction in which the rotation driven part 61*a* of the stirring bar 61 is bended, i.e., a longitudinal direction of the rotation driven part 61*a*, agrees with a distance direction in which the stirring part 61*d* is distantly disposed from the axial line of the stirring bar 61, whereas the bending direction of the rotation driven part 61*a* of the stirring bar 61 can be a direction opposite the distance direction of the stirring part 61*d*. The bending direction of the rotation driven part 61*a* of the stirring bar 61 may be a direction other than the same direction as and the opposite direction from the distance direction of the stirring part 61*d*. In this case, it is necessary to set a position of the stirring bar 61 again when the rotation driven part 61*a* of the stirring bar 61 is bended and so it is desirable in view of reducing a manufacturing time that the bending direction of the rotation driven part 61*a* of the stirring bar 61 should agree with the distance direction in which the stirring part 61*d* is distantly disposed from the axial line of the stirring bar 61.

Second Embodiment

As illustrated in the longitudinal sectional view of FIG. 17, the first embodiment describes an example where the light-emitting unit 64, the detection light guide 63 and the light-receiving unit 65 are disposed below the axial line of the second rotation shaft part 61*f* of the stirring bar 61. In contrast to this, as shown in FIG. 27, a second embodiment describes an example where arrangement of a light-emitting unit 264, a detection light guide 263, a light-receiving unit 265 and a stirring bar 261 are modified.

Figure 27:
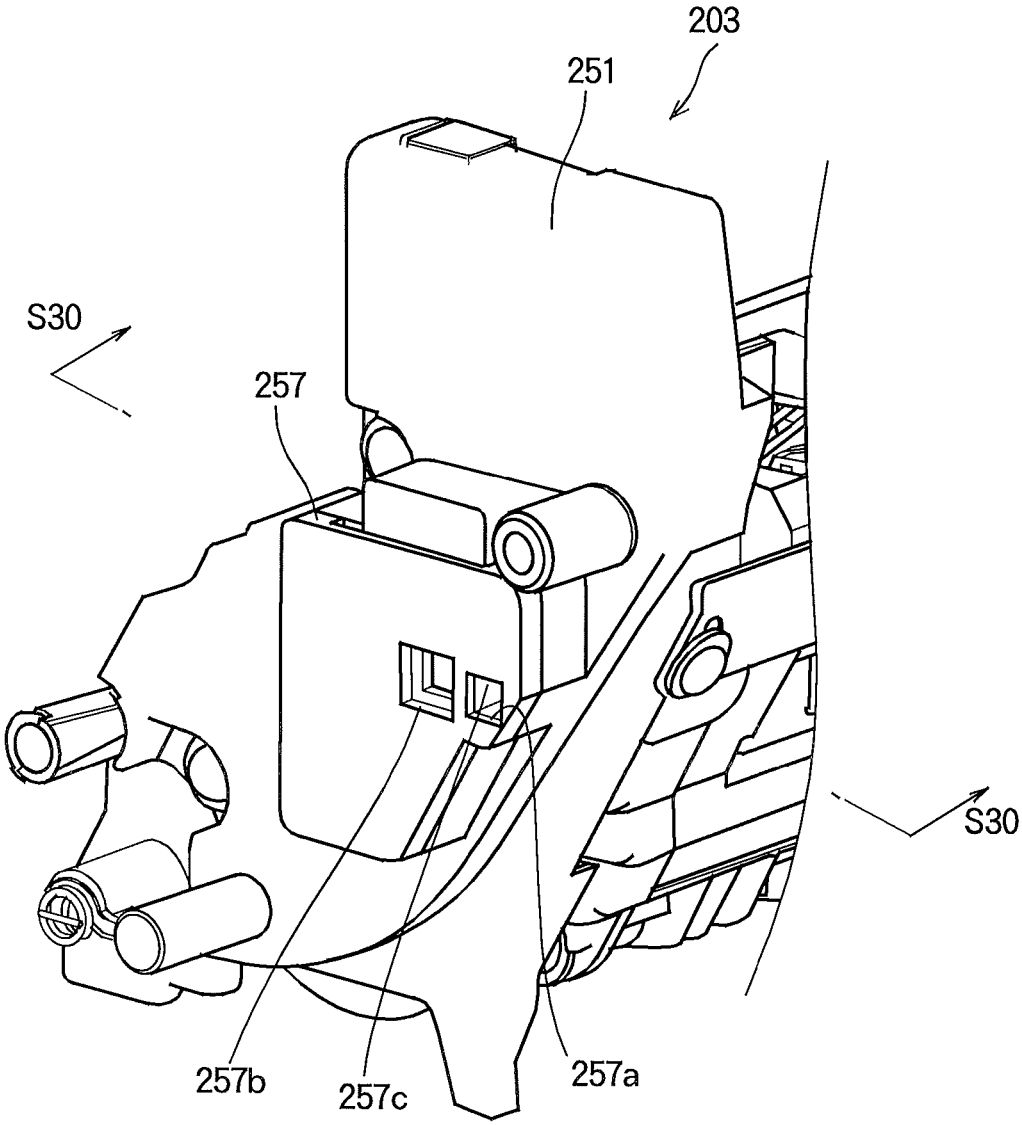
FIG. 27 is a perspective view schematically illustrating structure on a side of a second side plate when a developing unit includes a developer detection device according to a second embodiment.
Figure 28:
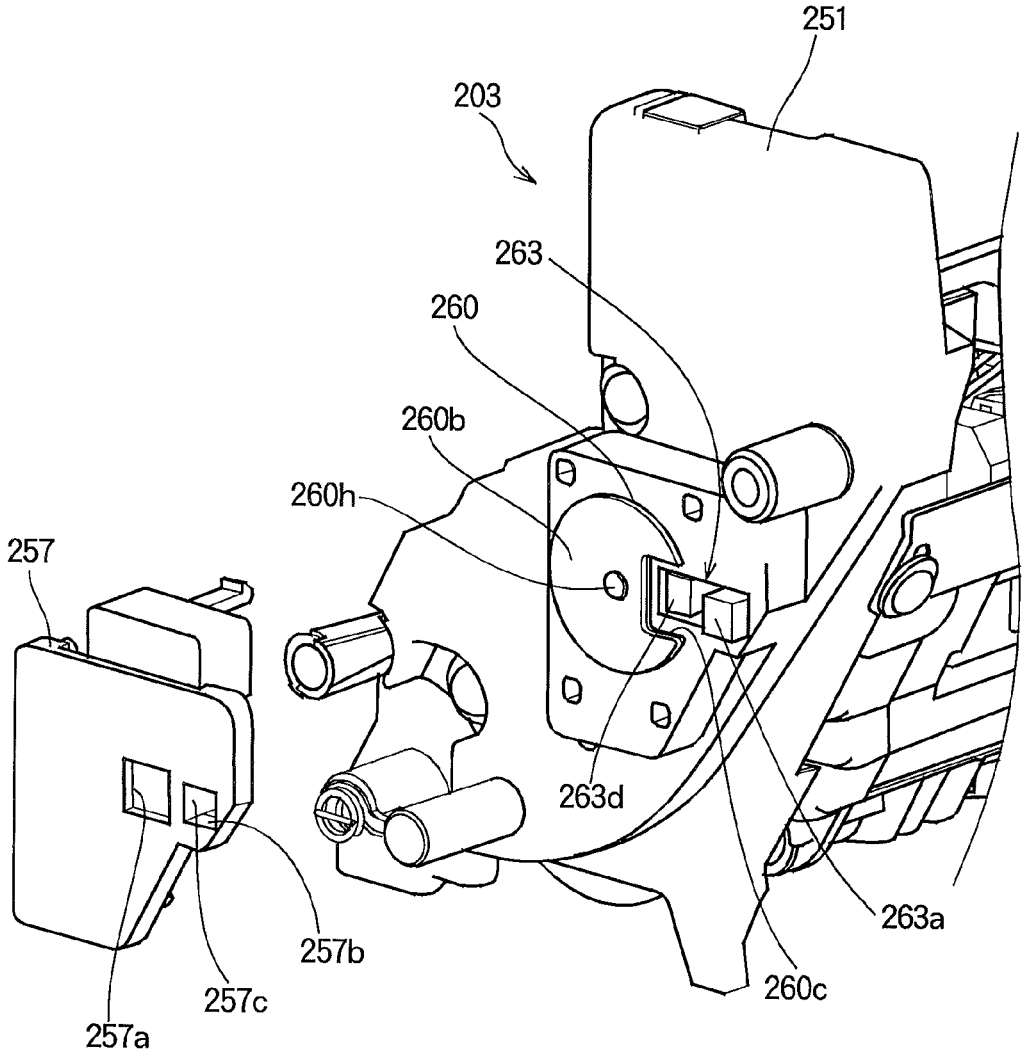
FIG. 28 is a perspective view schematically illustrating the developing unit of FIG. 27 when a plate cover is taken off.

FIG. 27 is a perspective view schematically illustrating structure on a side of a second side plate 251, in a developing unit 203 according to the second embodiment. FIG. 28 is a perspective view schematically illustrating the structure on the side of the second side plate 251, in the developing unit 203 of FIG. 27 when a plate cover 257 is taken off.

As illustrated in FIG. 27 and FIG. 28, the developing unit 203 according to the second embodiment differs from the developing unit 3 according to the first embodiment in a respect of arrangement of an entrance window 257*a*, an exit window 257*b* and a detection light guide rib 257*c* in the plate cover 257. As illustrated in FIG. 28, the entrance window 257*a*, the exit window 257*b* and the detection light guide rib 257*c* in the second embodiment are arranged so that the entrance window 257*a*, the exit window 257*b* and the detection light guide rib 257*c* are positioned at approximately the same height as a center 260*h* of a disc-shaped part 260*a* of a detection plate 260 and are aligned horizontally in a row.

As illustrated in FIG. 28, the detection plate 260 is accommodated inside the plate cover 257, and the detection light guide 263 is disposed so as to be approximately the same height as the center 260*h* of the disc-shaped part 260*a* of the detection plate 260. As illustrated in FIG. 28, the detection plate 260 in the second embodiment is set so that a light-passing section 260*c* of the detection plate 260 faces a light exit section 263*d* of the detection light guide 263 in a similar manner to the first embodiment, when the stirring part 61*d* of the stirring bar 61 is at a lower position, e.g., when the stirring part 61*d* is positioned below the rotation shaft parts of the stirring bar 61 and is positioned within a predetermined range which includes the lowest point of a rotation track.

Figure 29:
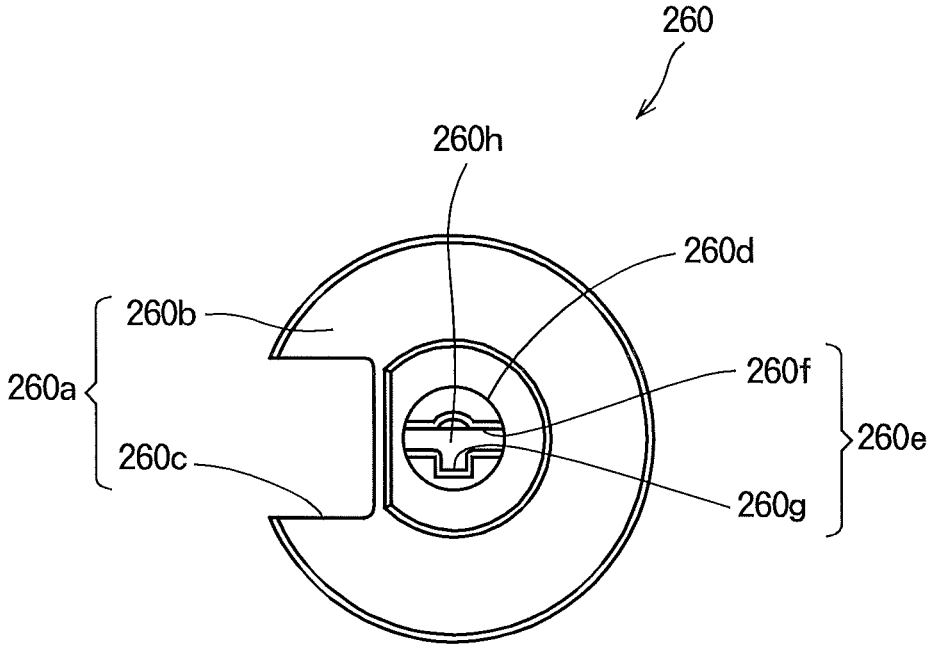
FIG. 29 is a front view schematically illustrating a detection plate of FIG. 28.

FIG. 29 is a front view illustrating the detection plate 260 of FIG. 28. The detection plate 260 in the second embodiment differs from the detection plate 60 in the first embodiment in a respect of structure of the disc-shaped part 260*a*. The disc-shaped part 260*a* of the detection plate 260 has a light-blocking section 260*b* and the light-passing section 260*c*. The light-passing section 260*c* of the detection plate 260 in the second embodiment is disposed on an extension line of a direction in which a first slot section 260*f* extends, i.e., a longitudinal direction of the first slot section 260*f*. Furthermore, in FIG. 29, the light-passing section 260*c* of the detection plate 260 is on the left side of the first slot section 260*f* so as to correspond to the detection light guide 263. However, if the detection light guide 263 is provided on the left side of the center 260*h* in FIG. 28, for example, the light-passing section 260*c* of the detection plate 260 need be provided on the right side of the first slot section 260*f* in FIG. 29.

Figure 30:
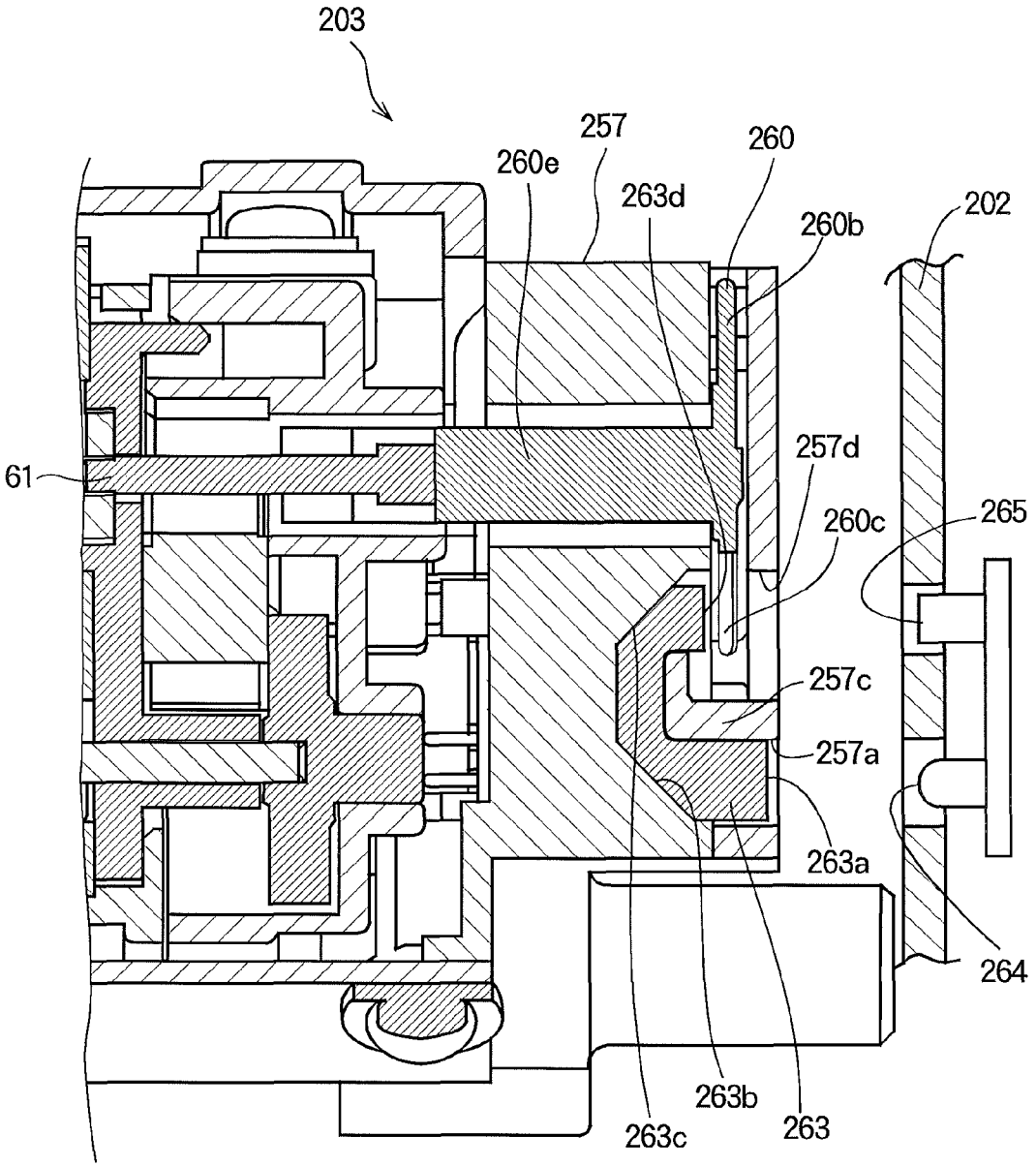
FIG. 30 is a transverse sectional view schematically illustrating structure on a side of a second side plate when the developing unit of FIG. 29 is installed in a housing of an image forming apparatus.

FIG. 30 is a transverse sectional view schematically illustrating structure on a side of the second side plate 251 when the developing unit 203 is installed in a housing 202, i.e., a cross-section of the structure in FIG. 27 taken along an S30-S30 line. As illustrated in FIG. 30, the housing 202 has the light-emitting unit 264 which includes a light-emitting element and the light-receiving unit 265 which includes a light-receiving element. When the developing unit 203 is installed in the housing 202, the light-emitting unit 264 and a light entrance section 263*a* face each other and the light-receiving unit 265 and a light exit section 263*d* of the detection light guide 263 face each other.

FIGS. 31A to 31E are explanatory diagrams illustrating various kinds of rotating operation of the stirring bar 61 in the second embodiment, which are different from each other depending on the amount of toner 9 stored in the toner stirring chamber 33. In FIGS. 31A to 31E, a reference numeral 9*a* denotes an upper surface of the toner 9 stored in the toner stirring chamber 33.

Figure 31A:
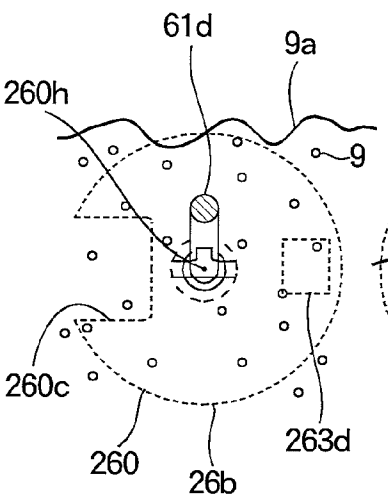
FIGS. 31A to 31E are explanatory diagrams schematically illustrating various kinds of rotating operation of a stirring bar in a developer detection device according to the second embodiment, which vary depending on the amount of toner stored in a toner stirring chamber.

As illustrated in FIG. 31A, when the toner stirring chamber 33 is filled with the toner 9, the stirring bar 61 rotates according to rotation of the rotation driving rib 62*b* of the stirring gear 62.

Figure 31B:
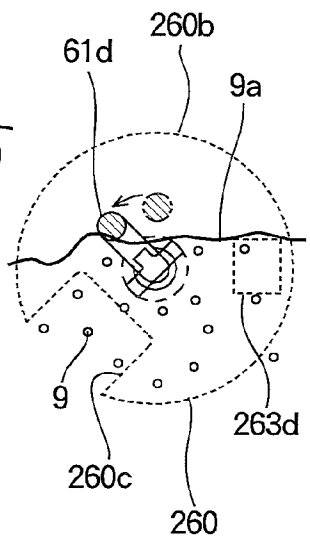
Figure 31C:
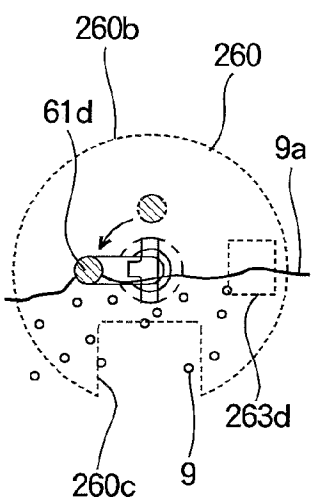

As illustrated in FIGS. 31B and 31C, when the amount of toner 9 stored in the toner stirring chamber 33 decreases, the stirring part 61*d* of the stirring bar 61 reaches the highest point of a rotation track and then the stirring bar 61 rotates by the weight of the stirring part 61*d*. The rotation of the stirring bar 61 stops, when the stirring part 61*d* reaches a toner upper surface position of the upper surface 9*a* of the toner 9 (strictly speaking, a position somewhat lower than the upper surface 9*a*). In the cases illustrated in FIGS. 31B and 31C, when the rotation of the stirring bar 61 by its own weight stops, the light-blocking section 260*b* of the detection plate 260 covers the light-emitting unit 264. Thus, a time period during which light from the light-emitting unit 264 is passing through the light-passing section 260*c* of the detection plate 260 is equal to a time period during which the light-passing section 260*c* of the detection plate 260 is passing through a position of the light-emitting unit 264 in a process of rotation of the detection plate 260 in accordance with the rotation of the rotation driving rib 62*b* of the stirring gear 62.

Figure 31D:
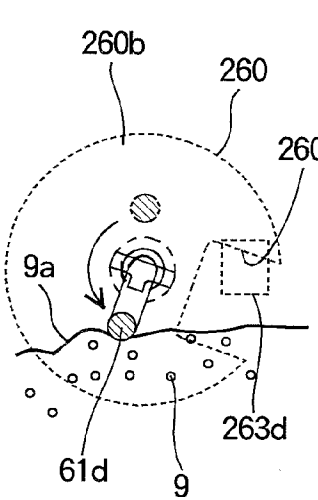
Figure 31E:
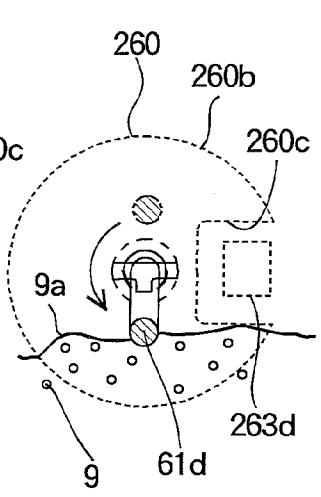
Figure 32:
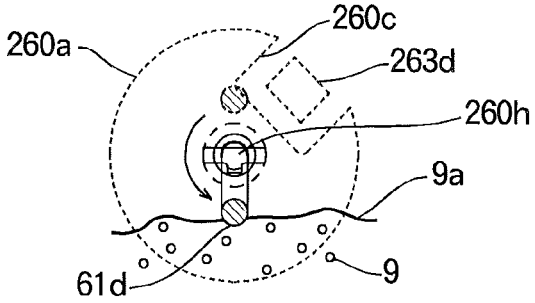
FIG. 32 is a diagram schematically illustrating a positional relationship between a light-passing section of a detection plate and a light exit section in a modified example of the developer detection device according to the second embodiment.
Figure 33:
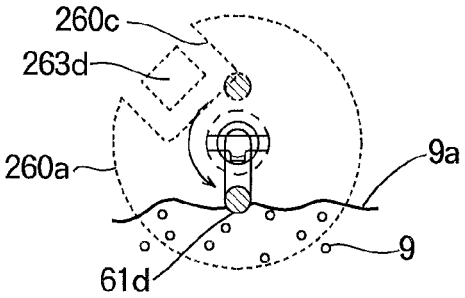
FIG. 33 is a diagram schematically illustrating a positional relationship between a light-passing section of a detection plate and a light exit section in another modified example of the developer detection device according to the second embodiment.
Figure 34:
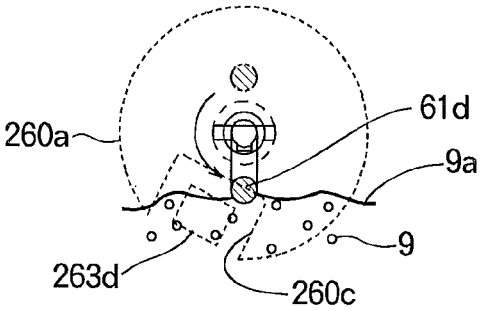
FIG. 34 is a diagram schematically illustrating a positional relationship between a light-passing section of a detection plate and a light exit section in still another modified example of the developer detection device according to the second embodiment.
Figure 35:
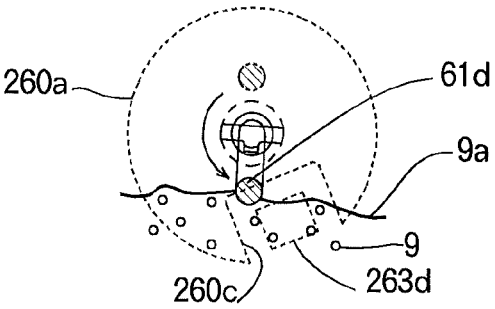
FIG. 35 is a diagram schematically illustrating a positional relationship between a light-passing section of a detection plate and a light exit section in yet another modified example of the developer detection device according to the second embodiment.

In the cases illustrated in FIGS. 31D and 31E, when the amount of toner 9 stored in the toner stirring chamber 33 further decreases and the rotation of the stirring bar 61 by its own weight stops, part of the light-passing section 260*c* of the detection plate 260 faces the light-emitting unit 264. At that time, a time period during which the light from the light-emitting unit 264 is passing through the light-passing section 260*c* of the detection plate 260 is longer than those in the cases illustrated in FIGS. 31A to 31C.

As described above, according to the second embodiment, positions of the light-emitting unit 264 and the light-receiving unit 265 can be changed by changing positions of the light-passing section 260*c* of the detection plate 260 and the detection light guide 263, and thus the positions can be comparatively freely selected. Therefore, flexibility is improved in designing the developer detection device, the developer accommodating device, the developing unit and the image forming apparatus, and there is an advantageous effect that a useless space in the device can be reduced, for example.

FIG. 32 to FIG. 35 illustrate positions of a light-passing section 260*c* of the detection plate 260 and a light exit section 263*d* in modified examples of the developing unit according to the second embodiment. In these examples illustrated in FIG. 32 to FIG. 35, the light-emitting unit 264 and the light-receiving unit 265 are disposed to be approximately the same height as the light exit section 263*d*, and the light-emitting unit 264 and the light-receiving unit 265 are arranged in a row on the right and the left as illustrated in FIG. 17. However, the light-emitting unit 264, the light-receiving unit 265, and the light exit section 263*d* can be disposed at any of other positions illustrated in any of FIG. 32 to FIG. 35, which indicate positions defined by moving them in a circumferential direction about the center 260*h* of the disc-shaped part 260*a*. In such cases illustrated in FIG. 32 to FIG. 35, the toner detection device is formed so that the light-passing section 260*c* of the detection plate 260 faces the light exit section 263*d* when the stirring part 61*d* of the stirring bar 61 is at a lower position in a rotation track, e.g., when the stirring part 61*d* is within a predetermined range including the lowest point of the rotation track.

Third Embodiment

Figure 36:
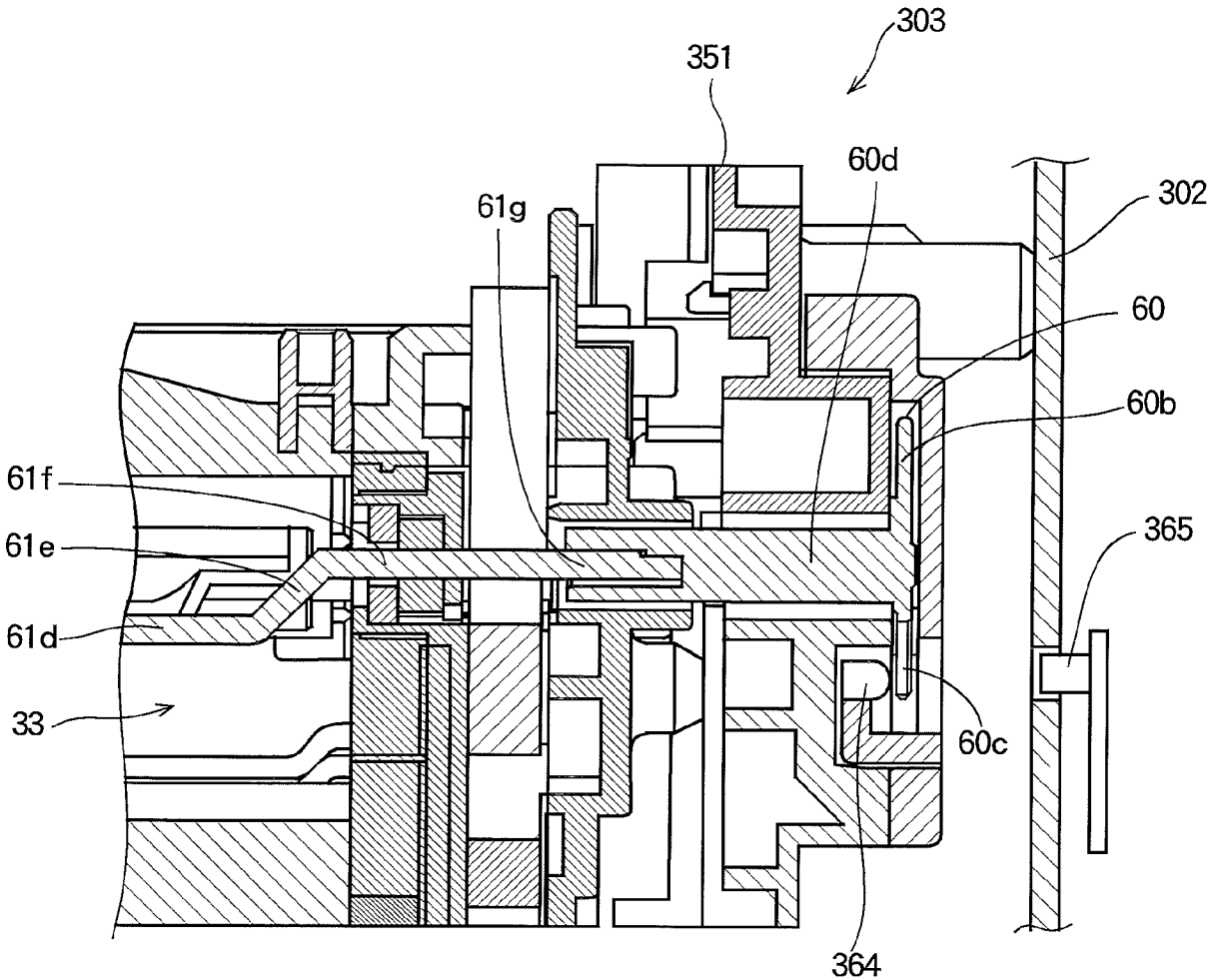
FIG. 36 is a longitudinal sectional view schematically illustrating structure on a side of a second side plate when a developing unit including a developer detection device according to a third embodiment is installed in a housing of an image forming apparatus.

FIG. 36 is a longitudinal sectional view schematically illustrating structure on a side of a second side plate when a developing unit 303 according to a third embodiment is installed in a housing 302. The developing unit 303 according to the third embodiment differs from the developing units 3 and 203 according to the first and second embodiments in a respect that a light-emitting unit 364 and a light-receiving unit 365 face with each other with the detection plate 60 (i.e., the light-passing section 60*c* or the light-blocking section 60*d*) interposed therebetween, as illustrated in FIG. 36. Except for this point, the developing unit 303 according to the third embodiment is substantially the same as the developing units according to the first and second embodiments. Furthermore, the positions of the light-emitting unit 364 and the light-receiving unit 365 are interchangeable with each other.

A developer detection device according to the third embodiment need not have the detection light guides 63 and 263 which are necessary components in the first and second embodiments, and thus can realize a simple structure.

MODIFIED EXAMPLES

In the first to third embodiments, a description has been made as to a case where the developer detection devices are devices for detecting the amount of toner stored in the toner stirring chamber 33 of the developing unit. However, the developer detection device may be a device for detecting the amount of toner stored in the toner cartridge 10, the amount of toner stored in the waste toner accommodating container 40, or the like.

Furthermore, in the first and second embodiments, a description has been made as to a case where the detection light guides 63 and 263 in the developer detection devices are prisms. However, the detection light guides 63 and 263 may be a component of hollow structure having a plurality of reflection mirrors, in which the first reflection surfaces 63*b*, 263*b* and the second reflection surfaces 63*c* and 263*b* are formed by reflection mirrors, for example.

Moreover, the present invention is not limited to the developer detection devices, the developer accommodating devices, the developing units and the image forming apparatuses according to the first to third embodiments described above. Various modifications can be made without departing from the spirit of the present invention, and all such modifications can be included within the scope of the present invention.

What is claimed is:

1. A developer accommodating device, comprising:

an accommodating container configured to store a developer;

a rotating member including a first part and a second part joined to the first part, the first part having a light-blocking section and a light-passing section, the second part having a rotation shaft, a stirring part and a linking part, the rotation shaft rotating around an axial line of the rotation shaft, the stirring part extending in a direction substantially parallel to the axial line of the rotation shaft, the linking part extending in a direction crossing the axial line of the rotation shaft and linking an end of the rotation shaft and an end of the stirring part;

a rotation driving member configured to rotate the rotating member in a predetermined direction; and an optical member including a light entrance surface and a light exit surface facing a same direction as the light entrance surface, the light entrance surface receiving light emitted in a first direction from a light-emitting unit disposed outside the developer accommodating device, the light received at the light entrance surface exiting from the light exit surface toward a light-receiving unit disposed outside the developer accommodating device in a second direction substantially opposite to the first direction, the light entrance surface and the light exit surface being disposed at an end and another end of the optical member, respectively;

wherein the rotating member starts rotating by the rotation driving member, and then rotates based on the weight of the rotating member when the stirring part reaches a predetermined rotation position, the rotation of the rotating member based on the weight of the rotating member being stopped by the developer when the stirring part contacts an upper surface of the developer stored in the accommodating container;

wherein the rotating member is formed so that when the stirring part is positioned at a lowest position of a rotation track thereof, the light-passing section is positioned on an optical path from the light-emitting unit to the light-receiving unit; and wherein the light-blocking section and the light-passing section are positioned between a first imaginary plane and a second imaginary plane, the first imaginary plane being parallel to the light entrance surface and including the light entrance surface, and the second imaginary plane being parallel to the light exit surface and including the light exit surface.

2. The developer accommodating device according to claim 1, wherein an area of the light-blocking section is larger than an area of the light-passing section.

3. The developer accommodating device according to claim 1, wherein the optical member further includes a first reflecting part configured to reflect the light received at the light entrance surface in a third direction, which is substantially orthogonal to the first direction, and a second reflecting part configured to reflect the light reflected in the third direction by the first reflecting part toward the light exit surface in the second direction.

4. The developer accommodating device according to claim 1, wherein a distance between the light entrance surface and the light-emitting unit is less than a distance between the light exit surface and the light-receiving unit.

5. The developer accommodating device according to claim 1, wherein when the stirring part is positioned at the lowest position, the light-passing section is positioned at a lowest position of a rotation track thereof.

6. The developer accommodating device according to claim 1, wherein when the stirring part is positioned at the lowest position, the light-passing section is positioned at a position different from a lowest position of a rotation track thereof.

7. A developing unit, comprising:

the developer accommodating device of claim 1;

an image carrier on which an electrostatic latent image is formed;

a developing member configured to develop the electrostatic latent image by the developer; and a supplying member configured to supply the developer to the developing member.

8. An image forming apparatus, comprising:

the developing unit of claim 7;

the light-emitting unit;

the light-receiving unit; and a control unit configured to measure a time period during which the light-receiving unit receives the light emitted from the light-emitting unit through the optical member, and determine the amount of the developer stored in the accommodating container on the basis of the measured time period.

9. An image forming apparatus, comprising:

the developer accommodating device of claim 1;

the light-emitting unit;

the light-receiving unit; and a control unit configured to measure a time period during which the light-receiving unit receives the light emitted from the light-emitting unit through the optical member, and determine the amount of the developer stored in the accommodating container on the basis of the measured time period.

10. The developer accommodating device according to claim 1, wherein the light entrance surface and the light exit surface are spatially independent.

11. The developer accommodating device according to claim 1, wherein the light exit surface faces the light-blocking section and the light-passing section.

* * * * *